US007768188B2

(12) United States Patent
Sasaki et al.

(10) Patent No.: US 7,768,188 B2
(45) Date of Patent: Aug. 3, 2010

(54) DISPLAY DEVICE

(75) Inventors: Takashi Sasaki, Hiratsuka (JP); Akira Otsuka, Zama (JP); Akihiro Takagi, Kawaguchi (JP)

(73) Assignee: Fujitsu Hitachi Plasma Display Limited, Miyazaki (JP)

( * ) Notice: Subject to any disclaimer, the term of this patent is extended or adjusted under 35 U.S.C. 154(b) by 593 days.

(21) Appl. No.: 11/705,757

(22) Filed: Feb. 14, 2007

(65) Prior Publication Data

US 2007/0296325 A1 Dec. 27, 2007

(30) Foreign Application Priority Data

Jun. 26, 2006 (JP) ..... 2006-175672

(51) Int. Cl.
*H01J 63/04* (2006.01)

(52) U.S. Cl. ..... 313/483

(58) Field of Classification Search ..... 313/582–587, 313/483

See application file for complete search history.

(56) References Cited

U.S. PATENT DOCUMENTS 4,741,962 A * 5/1988 Wada et al. ..... 428/428
5,838,105 A * 11/1998 Mitomo ..... 313/582
5,892,492 A * 4/1999 Osawa et al. ..... 345/60
6,242,859 B1 * 6/2001 Betsui et al. ..... 313/584
6,630,788 B1 * 10/2003 Park ..... 313/582
6,864,631 B1 * 3/2005 Wedding ..... 313/587
2002/0145386 A1 10/2002 Oishi et al.
2003/0122487 A1 * 7/2003 Kwon ..... 313/586
2004/0232842 A1 * 11/2004 Inoue ..... 313/584
2005/0029943 A1 * 2/2005 Irie et al. ..... 313/582

FOREIGN PATENT DOCUMENTS

JP 2002-313242 10/2002
JP 2000-353474 12/2002
JP 2003-157017 A 5/2003

* cited by examiner

*Primary Examiner*—Toan Ton
*Assistant Examiner*—Hana A Sanei
(74) *Attorney, Agent, or Firm*—McDermott Will & Emery LLP

(57) ABSTRACT

An optical filter is provided on the output side of light from plural kinds of cells that output light with colors different from one another. In the optical filter, the penetrable rate of at least a portion of the wavelength band of light output from the cell with the color having highest luminescent intensity is set lower than that of the wavelength band of other kinds of cells. Consequently, the reflectance rate of outer light incident to a display can be reduced. Particularly, in a room environment using artificial lighting, the reflectance rate of outer light can be reduced in the wavelength band of light with relatively high luminescent intensity. Resultingly, bright room contrast can be improved by suppressing the reflection of outer light. Since the penetrable rate of the color with the highest luminescent intensity is reduced, reduction in brightness of the display can be kept to a minimum.

2 Claims, 25 Drawing Sheets

| RC | | GC | | BC | | |
|---|---|---|---|---|---|---|
| WRC | RPrate | WGC | GPrate | WBC | BPrate | Rrate |
| 1.000 | 1.000 | 1.000 | 1.000 | 1.000 | 1.000 | 1.0000 |
| 0.995 | 1.005 | 1.010 | 0.990 | 0.995 | 1.005 | 0.9921 |
| 0.990 | 1.010 | 1.020 | 0.980 | 0.990 | 1.010 | 0.9845 |
| 0.985 | 1.016 | 1.031 | 0.970 | 0.985 | 1.016 | 0.9772 |
| 0.979 | 1.021 | 1.042 | 0.960 | 0.979 | 1.021 | 0.9702 |
| 0.974 | 1.027 | 1.053 | 0.950 | 0.974 | 1.027 | 0.9634 |
| 0.968 | 1.033 | 1.064 | 0.940 | 0.968 | 1.033 | 0.9570 |
| 0.962 | 1.039 | 1.075 | 0.930 | 0.962 | 1.039 | 0.9508 |
| 0.957 | 1.045 | 1.087 | 0.920 | 0.957 | 1.045 | 0.9450 |
| 0.951 | 1.052 | 1.099 | 0.910 | 0.951 | 1.052 | 0.9396 |
| 0.944 | 1.059 | 1.111 | 0.900 | 0.944 | 1.059 | 0.9344 |
| 0.938 | 1.066 | 1.124 | 0.890 | 0.938 | 1.066 | 0.9297 |
| 0.932 | 1.073 | 1.136 | 0.880 | 0.932 | 1.073 | 0.9253 |
| 0.925 | 1.081 | 1.149 | 0.870 | 0.925 | 1.081 | 0.9213 |
| 0.919 | 1.089 | 1.163 | 0.860 | 0.919 | 1.089 | 0.9178 |
| 0.912 | 1.097 | 1.176 | 0.850 | 0.912 | 1.097 | 0.9147 |
| 0.905 | 1.105 | 1.190 | 0.840 | 0.905 | 1.105 | 0.9120 |
| 0.898 | 1.114 | 1.205 | 0.830 | 0.898 | 1.114 | 0.9098 |
| 0.890 | 1.123 | 1.220 | 0.820 | 0.890 | 1.123 | 0.9082 |
| 0.883 | 1.133 | 1.235 | 0.810 | 0.883 | 1.133 | 0.9070 |
| **0.875** | **1.143** | **1.250** | **0.800** | **0.875** | **1.143** | **0.9064** |
| 0.867 | 1.153 | 1.266 | 0.790 | 0.867 | 1.153 | 0.9065 |
| 0.859 | 1.164 | 1.282 | 0.780 | 0.859 | 1.164 | 0.9072 |
| 0.851 | 1.176 | 1.299 | 0.770 | 0.851 | 1.176 | 0.9085 |
| 0.842 | 1.188 | 1.316 | 0.760 | 0.842 | 1.188 | 0.9106 |
| 0.833 | 1.200 | 1.333 | 0.750 | 0.833 | 1.200 | 0.9135 |
| 0.824 | 1.213 | 1.351 | 0.740 | 0.824 | 1.213 | 0.9172 |
| 0.815 | 1.227 | 1.370 | 0.730 | 0.815 | 1.227 | 0.9218 |
| 0.806 | 1.241 | 1.389 | 0.720 | 0.806 | 1.241 | 0.9274 |
| 0.796 | 1.257 | 1.408 | 0.710 | 0.796 | 1.257 | 0.9341 |
| 0.786 | 1.273 | 1.429 | 0.700 | 0.786 | 1.273 | 0.9419 |
| 0.775 | 1.290 | 1.449 | 0.690 | 0.775 | 1.290 | 0.9510 |
| 0.765 | 1.308 | 1.471 | 0.680 | 0.765 | 1.308 | 0.9615 |
| 0.754 | 1.327 | 1.493 | 0.670 | 0.754 | 1.327 | 0.9734 |
| 0.742 | 1.347 | 1.515 | 0.660 | 0.742 | 1.347 | 0.9871 |
| 0.731 | 1.368 | 1.538 | 0.650 | 0.731 | 1.368 | 1.0025 |
| 0.719 | 1.391 | 1.563 | 0.640 | 0.719 | 1.391 | 1.0201 |
| 0.706 | 1.416 | 1.587 | 0.630 | 0.706 | 1.416 | 1.0399 |
| 0.694 | 1.442 | 1.613 | 0.620 | 0.694 | 1.442 | 1.0622 |
| 0.680 | 1.470 | 1.639 | 0.610 | 0.680 | 1.470 | 1.0875 |
| 0.667 | 1.500 | 1.667 | 0.600 | 0.667 | 1.500 | 1.1160 |
| 0.653 | 1.532 | 1.695 | 0.590 | 0.653 | 1.532 | 1.1482 |
| 0.638 | 1.568 | 1.724 | 0.580 | 0.638 | 1.568 | 1.1847 |
| 0.623 | 1.606 | 1.754 | 0.570 | 0.623 | 1.606 | 1.2262 |
| 0.607 | 1.647 | 1.786 | 0.560 | 0.607 | 1.647 | 1.2733 |
| 0.591 | 1.692 | 1.818 | 0.550 | 0.591 | 1.692 | 1.3271 |
| 0.574 | 1.742 | 1.852 | 0.540 | 0.574 | 1.742 | 1.3887 |
| 0.557 | 1.797 | 1.887 | 0.530 | 0.557 | 1.797 | 1.4597 |
| 0.538 | 1.857 | 1.923 | 0.520 | 0.538 | 1.857 | 1.5418 |
| 0.520 | 1.925 | 1.961 | 0.510 | 0.520 | 1.925 | 1.6376 |
| 0.500 | 2.000 | 2.000 | 0.500 | 0.500 | 2.000 | 1.7500 |

Fig. 11

| RC | | GC | | BC | | |
|---|---|---|---|---|---|---|
| WRC | RPrate | WGC | GPrate | WBC | BPrate | Rrate |
| 1.000 | 1.000 | 1.000 | 1.000 | 1.000 | 1.000 | 1.0000 |
| 1.000 | 1.000 | 1.010 | 0.990 | 0.990 | 1.010 | 0.9901 |
| 1.000 | 1.000 | 1.020 | 0.980 | 0.980 | 1.021 | 0.9805 |
| 1.000 | 1.000 | 1.031 | 0.970 | 0.969 | 1.032 | 0.9710 |
| 1.000 | 1.000 | 1.042 | 0.960 | 0.958 | 1.043 | 0.9618 |
| 1.000 | 1.000 | 1.053 | 0.950 | 0.947 | 1.056 | 0.9529 |
| 1.000 | 1.000 | 1.064 | 0.940 | 0.936 | 1.068 | 0.9443 |
| 1.000 | 1.000 | 1.075 | 0.930 | 0.925 | 1.081 | 0.9359 |
| 1.000 | 1.000 | 1.087 | 0.920 | 0.913 | 1.095 | 0.9278 |
| 1.000 | 1.000 | 1.099 | 0.910 | 0.901 | 1.110 | 0.9200 |
| 1.000 | 1.000 | 1.111 | 0.900 | 0.889 | 1.125 | 0.9126 |
| 1.000 | 1.000 | 1.124 | 0.890 | 0.876 | 1.141 | 0.9055 |
| 1.000 | 1.000 | 1.136 | 0.880 | 0.864 | 1.158 | 0.8987 |
| 1.000 | 1.000 | 1.149 | 0.870 | 0.851 | 1.176 | 0.8924 |
| 1.000 | 1.000 | 1.163 | 0.860 | 0.837 | 1.194 | 0.8864 |
| 1.000 | 1.000 | 1.176 | 0.850 | 0.824 | 1.214 | 0.8809 |
| 1.000 | 1.000 | 1.190 | 0.840 | 0.810 | 1.235 | 0.8760 |
| 1.000 | 1.000 | 1.205 | 0.830 | 0.795 | 1.258 | 0.8715 |
| 1.000 | 1.000 | 1.220 | 0.820 | 0.780 | 1.281 | 0.8676 |
| 1.000 | 1.000 | 1.235 | 0.810 | 0.765 | 1.306 | 0.8643 |
| 1.000 | 1.000 | 1.250 | 0.800 | 0.750 | 1.333 | 0.8618 |
| 1.000 | 1.000 | 1.266 | 0.790 | 0.734 | 1.362 | 0.8600 |
| **1.000** | **1.000** | **1.282** | **0.780** | **0.718** | **1.393** | **0.8590** |
| 1.000 | 1.000 | 1.299 | 0.770 | 0.701 | 1.426 | 0.8591 |
| 1.000 | 1.000 | 1.316 | 0.760 | 0.684 | 1.462 | 0.8602 |
| 1.000 | 1.000 | 1.333 | 0.750 | 0.667 | 1.500 | 0.8625 |
| 1.000 | 1.000 | 1.351 | 0.740 | 0.649 | 1.542 | 0.8662 |
| 1.000 | 1.000 | 1.370 | 0.730 | 0.630 | 1.587 | 0.8716 |
| 1.000 | 1.000 | 1.389 | 0.720 | 0.611 | 1.636 | 0.8788 |
| 1.000 | 1.000 | 1.408 | 0.710 | 0.592 | 1.690 | 0.8882 |
| 1.000 | 1.000 | 1.429 | 0.700 | 0.571 | 1.750 | 0.9003 |
| 1.000 | 1.000 | 1.449 | 0.690 | 0.551 | 1.816 | 0.9154 |
| 1.000 | 1.000 | 1.471 | 0.680 | 0.529 | 1.889 | 0.9342 |
| 1.000 | 1.000 | 1.493 | 0.670 | 0.507 | 1.971 | 0.9577 |
| 1.000 | 1.000 | 1.515 | 0.660 | 0.485 | 2.063 | 0.9868 |
| 1.000 | 1.000 | 1.538 | 0.650 | 0.462 | 2.167 | 1.0229 |
| 1.000 | 1.000 | 1.563 | 0.640 | 0.438 | 2.286 | 1.0682 |
| 1.000 | 1.000 | 1.587 | 0.630 | 0.413 | 2.423 | 1.1253 |
| 1.000 | 1.000 | 1.613 | 0.620 | 0.387 | 2.583 | 1.1980 |
| 1.000 | 1.000 | 1.639 | 0.610 | 0.361 | 2.773 | 1.2921 |
| 1.000 | 1.000 | 1.667 | 0.600 | 0.333 | 3.000 | 1.4160 |

Fig. 15

DISPLAY DEVICE

CROSS REFERENCE TO RELATED APPLICATION

This application is based upon and claims the benefit of priority from Japanese Patent Application No. 2006-175672, filed on Jun. 26, 2006, the entire contents of which are incorporated herein by reference.

BACKGROUND OF THE INVENTION

1. Field of the Invention

The present invention relates to a display device that displays an image.

2. Description of the Related Art

Generally, in a display device, in order to suppress the reflection of outer light incident on the display and to improve bright room contrast, a filter having a predetermined penetrable rate is arranged on the display surface side of a panel. In addition, a technique has been proposed (for example, Japanese Unexamined Patent Application Publication No. 2003-157017), which improves bright room contrast by reducing the penetrable rate for wavelength bands except for the wavelength band of the light emitted from the display without reducing the brightness of the display.

Generally, in a room in which a display device is installed, the wavelength band of the outer light incident on the display often overlaps the wavelength band of the light emitted from the display. For example, the light of a fluorescent lamp, which is one of artificial lighting, is composed mainly of red, green, and blue light and the wavelength band of the light overlaps the wavelength band of the light emitted from the display. Conventionally, however, there has been proposed no technique that would improve the bright room contrast in the wavelength band that overlaps the wavelength band of the light emitted from the display.

SUMMARY OF THE INVENTION

An object of the present invention is to improve bright room contrast by suppressing the reflection of outer light.

In an embodiment of the present invention, an optical filter is provided on the output side of the light from plural kinds of cells that output light with color different from one another. In the optical filter, the penetrable rate of the wavelength band of the light output from the cell with the color having the highest luminescent intensity is set lower than that of the wavelength band of other kinds of cells. For example, when the display device has a red cell that emits red light, a green cell that emits green light, and a blue cell that emits blue light, and the luminescent intensity of the green cell is the highest, the penetrable rate of the wavelength band of the green light is set lower than that of the wavelength bands of the red and blue light. Due to this, it is possible to reduce the reflectance rate of outer light incident on the display. In particular, in a room environment in which artificial lighting is used, it is possible to reduce the reflectance rate of outer light in the wavelength band of the light having a comparatively high luminescent intensity. As a result, it is possible to improve bright room contrast by suppressing the reflection of outer light.

In another embodiment of the present invention, in a cell with a color having the highest luminescent intensity, luminescent intensity is further increased in order to compensate for the amount of light that will run short when the penetrable rate of an optical filter is reduced. For example, the improvement of luminescent intensity can be realized by applying at least any one of three conditions that (a) the cell width is widened, (b) the area of the transparent electrode is increased, and (c) the phosphor layer of the cell is thickened. Due to this, it is possible to make the luminescent intensity of the light from a cell with a color having the highest luminescent intensity equal to the conventional one at the output surface of the light of the optical filter. Consequently, it is possible to improve bright room contrast by suppressing the reflection of outer light without reducing the brightness of the display. In addition, it is possible to make the intensity ratio of the light from a plurality of kinds of cells equal to the conventional one at the output surface of the light of the optical filter. As a result, it is possible to make the hue, such as white balance, have the same quality as ever before.

In another embodiment of the present invention, a display device has a red cell that emits red light, a green cell that emits green light, and a blue cell that emits blue light. The luminescent intensity is the highest in the green cell, the next highest in the red cell, and the lowest in the blue cell. The penetrable rate of the light of an optical filter is the highest for the light of the blue wavelength band, the second highest for the light of the red wavelength band, and the lowest for the light of the green wavelength band. The blue cell has a narrow cell width than the red cell in order to reduce the amount of light that will be excessive when the penetrable rate of the optical filter is increased. It is possible to reduce the reflectance rate of outer light most effectively by reducing the penetrable rate and increasing the brightness of the color having a relatively high luminescent intensity, and by increasing the penetrable rate and reducing the brightness of the color having a relatively low luminescent intensity. As a result, it is possible to improve bright room contrast by suppressing the reflection of outer light without reducing the brightness of the display.

BRIEF DESCRIPTION OF THE DRAWINGS

The nature, principle, and utility of the invention will become more apparent from the following detailed description when read in conjunction with the accompanying drawings in which like parts are designated by identical reference numbers, in which:

FIG. 11 is an explanatory diagram showing the result of calculation for acquiring the characteristic in FIG. 10;

FIG. 15 is an explanatory diagram showing the result of calculation for acquiring the characteristic in FIG. 14;

DESCRIPTION OF THE PREFERRED EMBODIMENTS

Embodiments of the present invention are explained below with reference to drawings.

Figure 1:
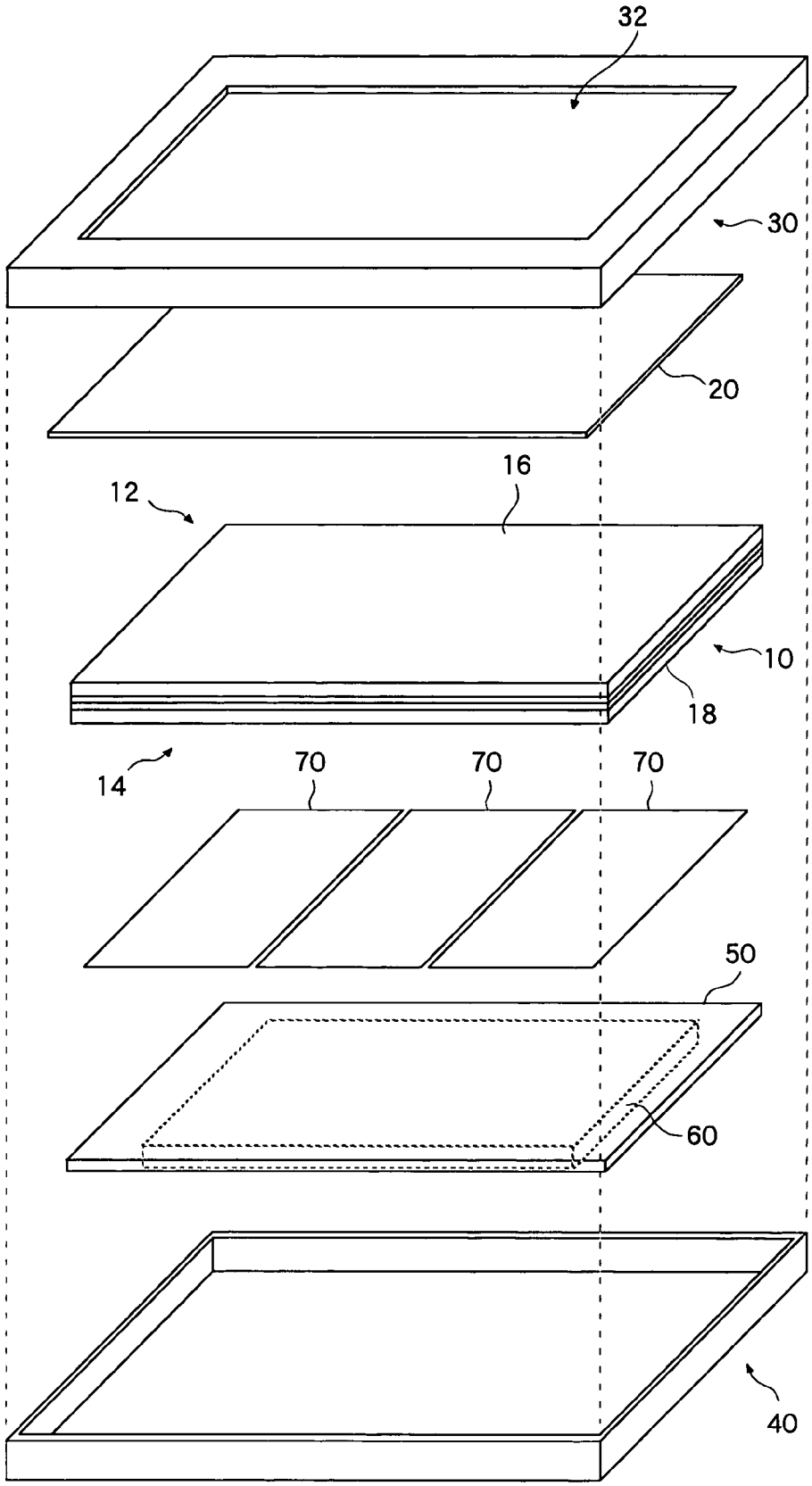
FIG. 1 is an exploded perspective view showing a first embodiment of a display device of the present invention.

FIG. 1 shows a first embodiment of a display device of the present invention. The display device in the present embodiment is configured as a plasma display panel device (hereinafter, also referred to as a PDP device). The PDP device has a rectangular plate-shaped plasma display panel 10 (hereinafter, also referred to as a PDP), an optical filter 20 provided on the side of an image display surface 12 (the output side of light), a front case 30 arranged on the image display surface 12 side of the PDP 10, a rear case 40 and a base chassis 50 arranged on the side of a rear surface 14 of the PDP 10, and a circuit unit 60 attached to the rear case 40 side of the base chassis 50 for driving the PDP 10. The PDP 10 is bonded to the base chassis 50 by a double-faced adhesive sheet 70. The circuit unit 60 is configured by a plurality of parts and therefore is shown by a broken-lined box in the figure.

The PDP 10 is configured by a front plate 16 constituting the image display surface 12 and a rear plate 18 in opposition to the front plate 16. There is formed a discharge space (cell), not shown, between the front plate 16 and the rear plate 18. The front plate 16 and the rear plate 18 are formed of, for example, a glass plate. The optical filter 20 is pasted to a protection glass (not shown) attached to an opening part 32 of the front case 30 and is integrated with the protection glass. In the optical filter 20, the penetrable rate of the wavelength band (wavelength region) of the light emitted from a green cell GC, which will be described later, is set lower than ever before. The characteristic of the optical filter 20 will be explained in FIG. 8 to be described later.

Figure 2:
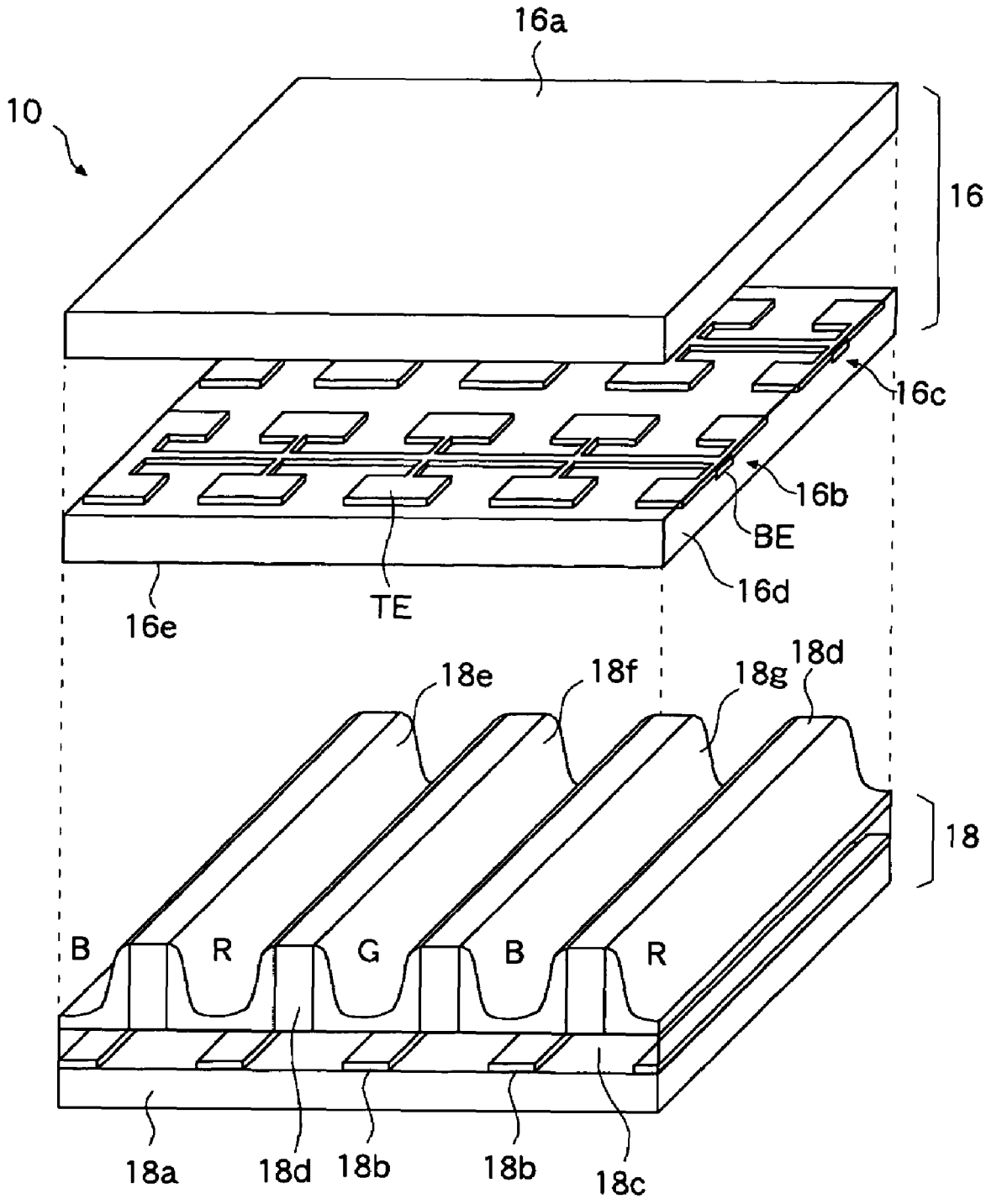
FIG. 2 is an exploded perspective view showing details of essential parts of a PDP shown in FIG. 1.

FIG. 2 shows details of the essential parts of the PDP 10 shown in FIG. 1. In order to cause a discharge to occur repeatedly, the front plate 16 has X electrodes 16*b* and Y electrodes 16*c* formed by turns in parallel to each other on a glass base 16*a* (beneath the glass base 16*a* in the figure). The X electrode 16*b* and the Y electrode 16*c* are configured by a transparent electrode TE, constricted in the middle, and a bus electrode BE extending in the transverse direction in the figure. The electrodes 16*b* and 16*c* are covered with a dielectric layer 16*d* and the surface of the dielectric layer 16*d* is covered with a protective layer 16*e*, such as MgO.

The rear plate 18 has address electrodes 18*b* formed in parallel to each other on a glass base 18*a*. The address electrode 18*b* is arranged in the direction perpendicular to the bus electrode BE. The address electrode 18*b* is covered with a dielectric layer 18*c*. On the dielectric layer 18*c*, barrier ribs 18*d* are formed at positions between the neighboring address electrodes 18*b*. The barrier ribs 18*d* constitute side walls of discharge cells to be described later. Further, onto the side surface of the barrier rib 18*d* and the dielectric layer 18*c* between the neighboring barrier ribs 18*d*, phosphors 18*e*, 18*f*, and 18*g* are applied, which emit visible light in red (R), green (G), and blue (B), respectively, when excited by ultraviolet rays. A cell (a pixel of a color) of the PDP 10 is formed in an area including a pair of transparent electrodes TE in an area surrounded by a pair of barrier ribs 18*d* adjacent to each other. As described above, the PDP 10 is configured by arranging the cells in a matrix in order to display an image and by arranging by turns a plurality of kinds of cells that emit light having colors different to one another.

The PDP 10 is configured by bonding the front plate 16 and the rear plate 18 such that the protective layer 16*e* and the barrier rib 18*d* come to contact with each other and by sealing in a discharge gas, such as Ne and Xe. The bus electrode BE and the address electrode 18*b* extend as far as the end part of the PDP 10 located outside of a sealing area formed on the outer circumferential part of the PDP 10 and is connected to a control circuit CNT shown in FIG. 5, which will be described later.

Figure 3:
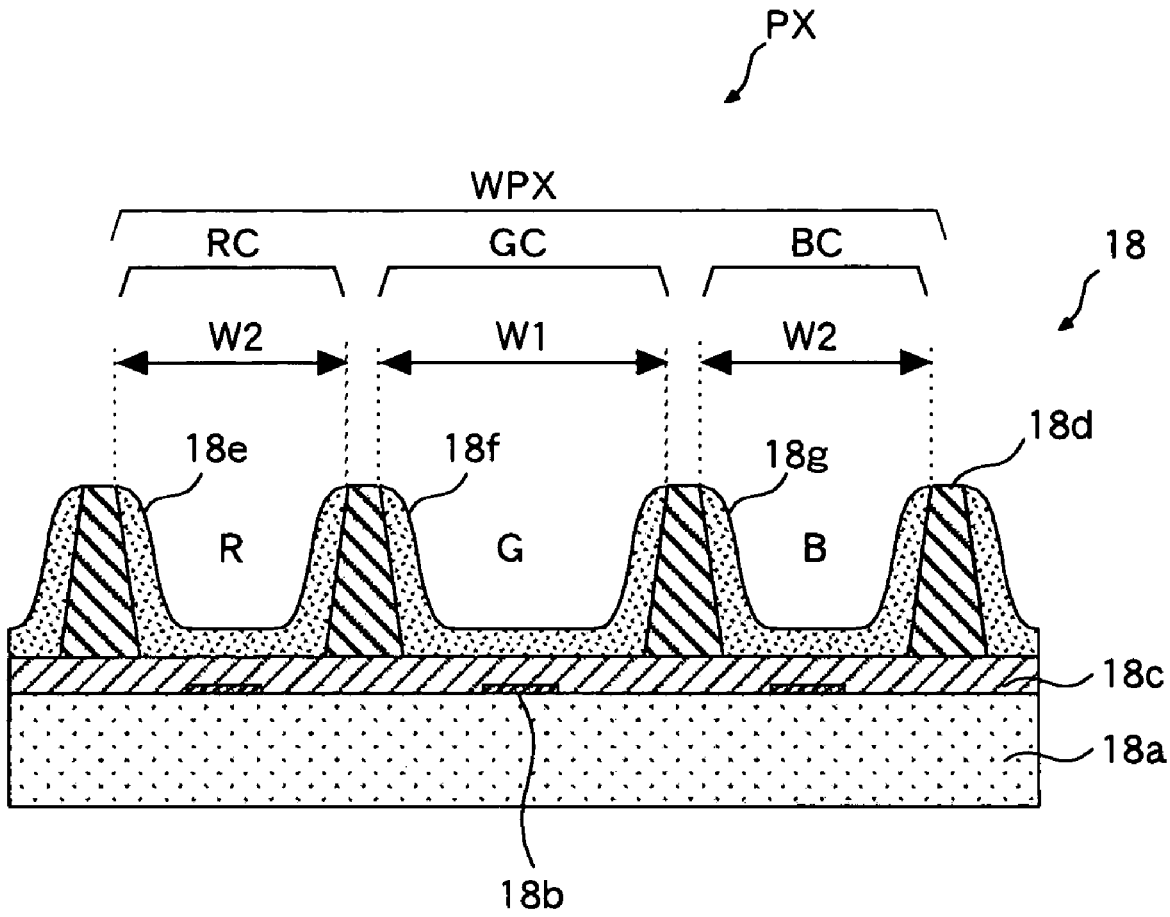
FIG. 3 is a sectional view showing details of a rear plate shown in FIG. 2.

FIG. 3 shows details of the rear plate 18 shown in FIG. 2. In the present embodiment, cell width W1 of the green cell GC that emits green light is wider than cell width W2 of a red cell RC that emits red light and a blue cell BC that emits blue light. Incidentally, width WPX of a pixel PX capable of producing color display including the red cell RC, the green cell GC, and the blue cell BC is the same as the conventional one. In other words, the cell width W2 of the red cell RC and the blue cell BC is reduced by the amount corresponding to an increase in the cell width W1 of the green cell GC compared to the conventional one. Due to this, it is possible to make the size and the number of pixels of the PDP 10 equal to the conventional ones. The luminescent intensity of each of the cells RC, GC, and BC increases with the increasing area to which phosphors are applied. Because of this, the luminescent intensity of the green cell GC becomes relatively high compared to the conventional one and the luminescent intensity of the red cell RC and blue cell BC becomes relatively low compared to the conventional one.

Figure 4:
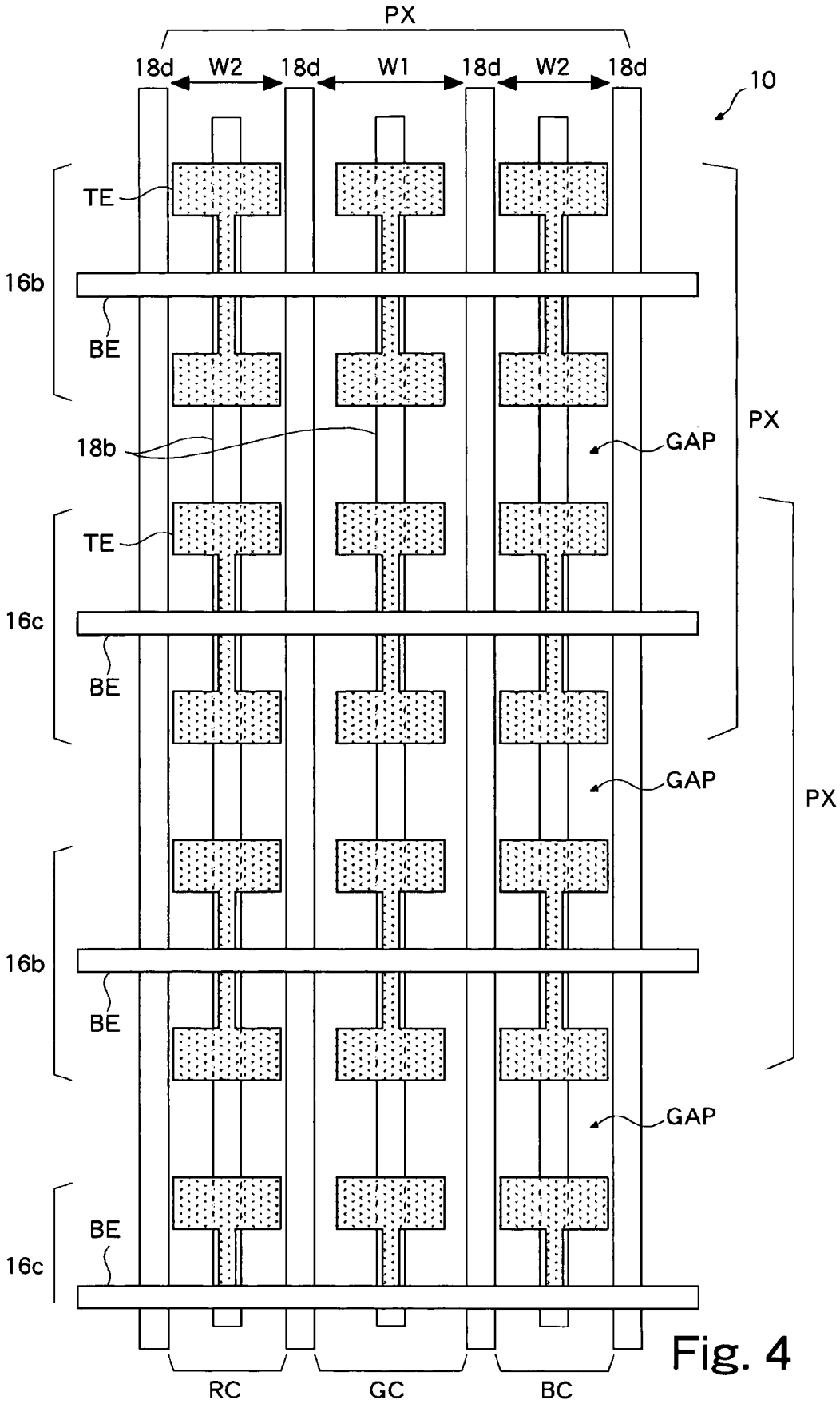
FIG. 4 is a plan view showing details of essential parts of the PDP shown in FIG. 2.

FIG. 4 shows details of the essential parts of the PDP 10 shown in FIG. 2. The bus electrodes BE are arranged both equidistantly and parallelly. On both sides (in the vertical direction in the figure) of the bus electrode BE, a discharge gap GAP for emitting light by discharge is formed. The red cell RC, the green cell GC, and the blue cell BC are formed respectively in areas including a pair of transparent electrodes TE. Further, the red cell RC, the green cell GC, and the blue cell BC constitute the single pixel PX. The pixels PX adjacent to each other in the vertical direction in the figure partially overlap each other. The PDP device of this kind is referred to as an ALIS method (Alternate Lighting of Surfaces Method). In the present embodiment, all of the transparent electrodes TE have the same shape and size irrespective of the color of the cell. All of the distances (between a pair of transparent electrodes TE) of the discharge gaps GAP are also the same irrespective of the color of the cell.

Figure 5:
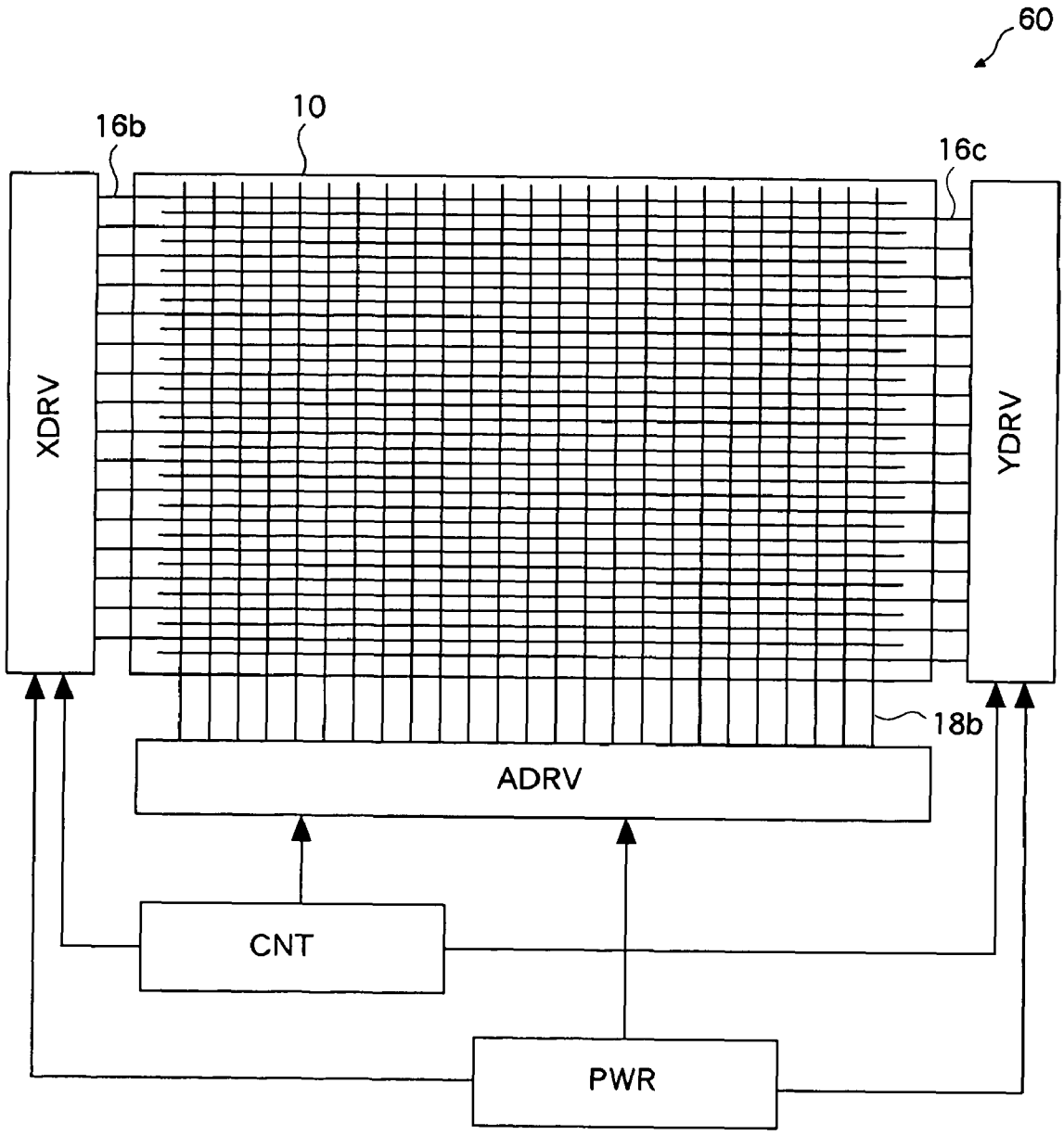
FIG. 5 is a block diagram showing the outline of a circuit unit shown in FIG. 1.

FIG. 5 shows the outline of the circuit unit 60 shown in FIG. 1. The circuit unit 60 has an X driver XDRV for driving the X electrodes 16*b*, a Y driver YDRV for driving the Y electrodes 16*c*, an address driver ADRV for driving the address electrodes 18*d*, a control circuit CNT for controlling the operation of the drivers XDRV, YDRV, and ADRV, and a power-supply circuit PWR.

Figure 6:
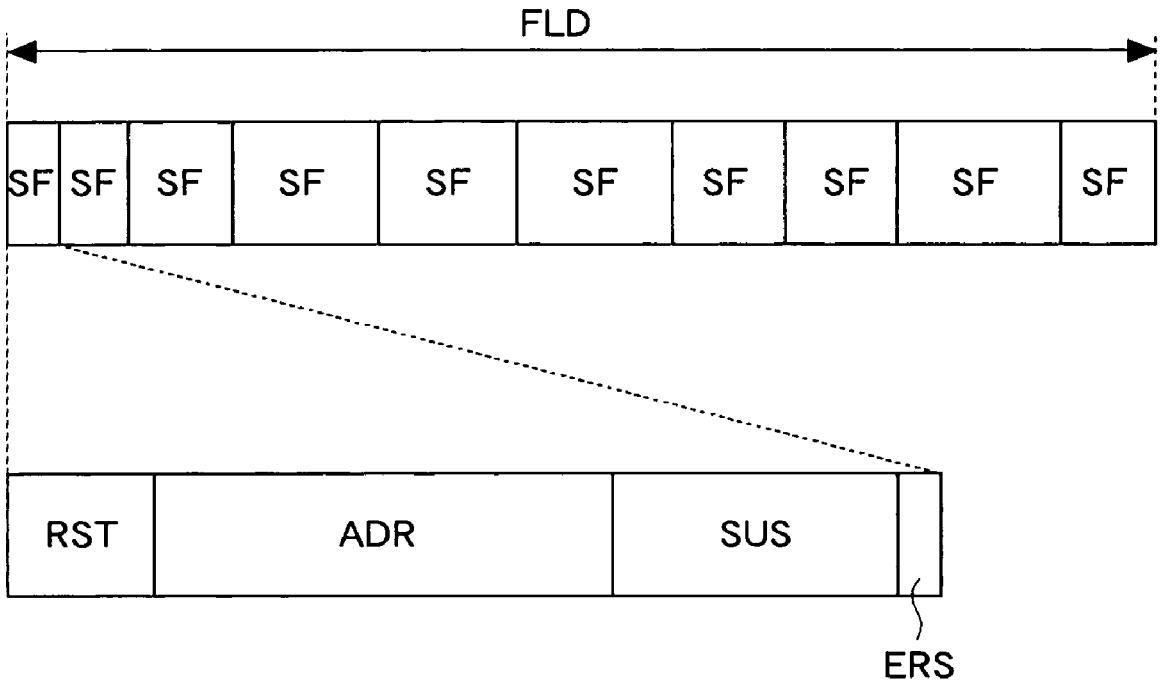
FIG. 6 is an explanatory diagram showing a configuration example of a field FLD for displaying an image of a screen.

FIG. 6 shows a configuration example of a field FLD for displaying an image of a screen. The length of one field FLD is 1/60 sec. and configured by 10 subfields SF. Each subfield SF is configured by a reset period RST, an address period ADR, a sustain period SUS, and an erase period ERS for wall charges. Incidentally, there may be the case where the erase period ERS is defined being included in the sustain period SUS because it is a period for causing a discharge to occur to erase wall charges only in the lit cells. Here, the wall charges are, for example, positive charges and negative charges accumulated on the MgO layer 16*e* shown in FIG. 2 in each cell. The reset period RST, the address period ADR, and the erase period ERS have the same length at all times, not depending on the subfield SF. The length of the sustain period SUS differs depending on the subfield F and depends on the number of discharges (brightness) of the cell. Because of this, gradation expression is made possible by changing combinations of subfields SF to be lit.

Figure 7:
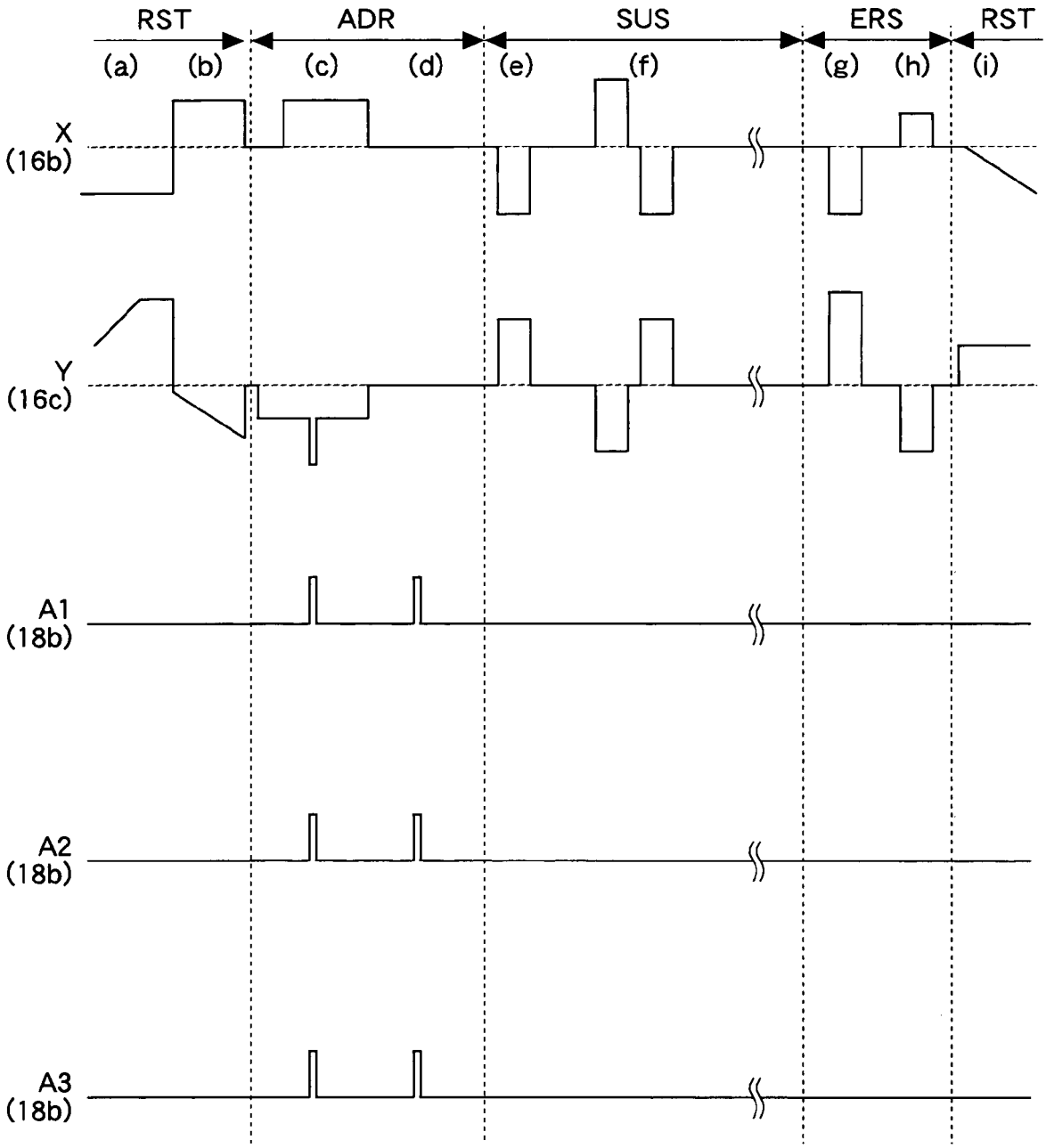
FIG. 7 is a waveform diagram showing an example of a discharge operation of a subfield SF.

FIG. 7 shows an example of the discharge operation of the subfield SF. First, in the reset period RST, a negative write voltage is applied to a sustain electrode X (X electrode 16*b*) and a positive write voltage (broad write wave) that rises gradually is applied to a scan electrode Y (Y electrode 16*c*) (FIG. 7(*a*)). Due to this, positive and negative wall charges are accumulated on the sustain electrode X and the scan electrode Y, respectively, while suppressing the emission in the cell. Next, a positive adjustment voltage is applied to the sustain electrode X and a negative adjustment voltage (broad adjustment wave) is applied to the scan electrode Y (FIG. 7(*b*)). Due to this, the amount of the wall charges is reduced and the wall charges in all of the cells become equal in amount.

In the address period ADR, a positive scan voltage is applied to the sustain electrode X, a negative scan pulse is applied to the scan electrode Y, and a positive address pulse is applied to address electrodes A1 to A3 (18*d*) corresponding to the cells to be lit (FIG. 7(*c*)). The cell selected by the address pulse starts to discharge. Incidentally, in this example, the operation for lighting up the cell on an odd-numbered line is shown. The second time address pulse shown in the waveform of the address electrode ADR is applied to select a cell on an even-numbered line (FIG. 7(*d*)).

In the sustain period SUS, negative and positive first sustain pulses are applied to the sustain electrode X and the scan electrode Y, respectively (FIG. 7(*e*)). Due to this, the discharge state of the lit cell is maintained. After this, sustain pulses having polarities different from each other are applied repeatedly to the sustain electrode X and the scan electrode Y and a discharge is caused to occur repeatedly in the cell that has lit up in the sustain period SUS (FIG. 7 (*f*)).

In the erase period ERS, a negative pre-erase pulse and a high voltage pre-erase pulse are applied to the sustain electrode X and the scan electrode Y, respectively (FIG. 7(*g*)). Due to this, wall charges are accumulated on the sustain electrode X and the scan electrode Y. At this time, the amount of wall charges accumulated on the scan electrode Y becomes relatively large because a high voltage is applied thereto. Next, a positive erase pulse and a negative erase pulse are applied to the sustain electrode X and the scan electrode Y, respectively (FIG. 7(*h*)). Due to this, a weak discharge occurs and the amount of wall charges is reduced. Finally, for the transfer to the next reset period RST, a negative voltage (broad wave) that decreases gradually is applied to the sustain electrode X and a positive pulse is applied to the scan electrode Y (FIG. 7(*i*)). Due to this, one subfield period SF is completed.

Figure 8:
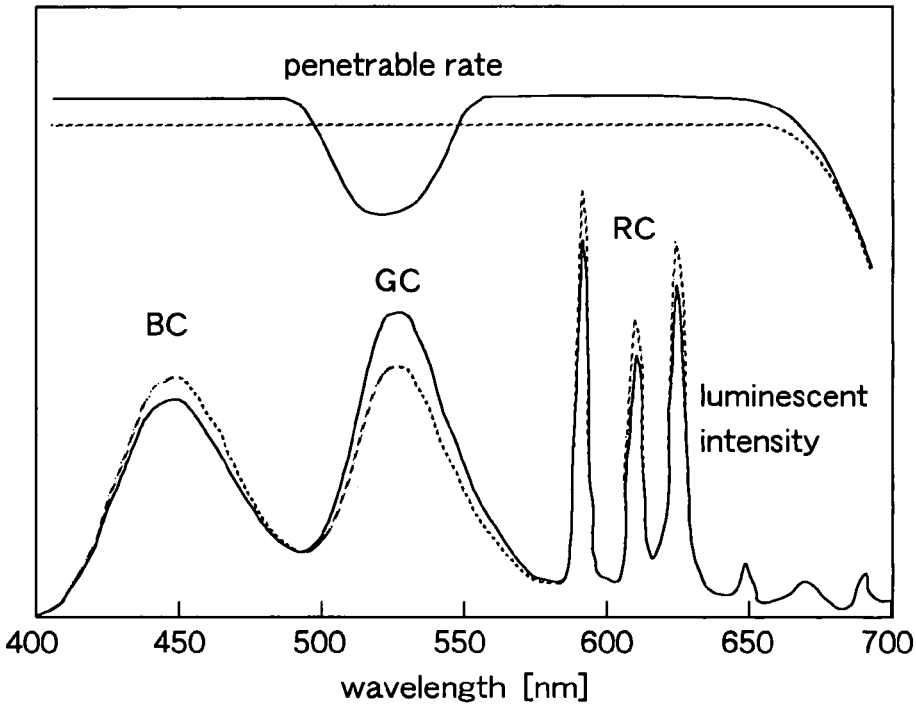
FIG. 8 is a characteristic diagram showing the wavelength dependence of the penetrable rate of the optical filter and the luminescent intensity of the cell shown in FIG. 1.

FIG. 8 shows the wavelength dependence of the penetrable rate of the optical filter 20 and the luminescent intensity of the cell shown in FIG. 1. The broken line in the figures shows the conventional characteristic and the solid line shows the characteristic of the present invention. In the present embodiment, as shown in FIG. 3, the cell width of the green cell GC is designed to be wider compared to the conventional one and the cell width of the red cell RC and the blue cell BC is designed to be narrower compared to the conventional one. Because of this, the luminescent intensity of the wavelength band of green light emitted from the green cell GC becomes higher compared to the conventional one. In other words, the luminescent intensity of green light is further increased compared to the conventional one in order to compensate for the amount of light that will run short because the penetrable rate of the optical filter 20 is reduced. The luminescent intensity of the wavelength band of red light emitted from the red cell RC and the luminescent intensity of the wavelength band of blue light emitted from the blue cell BC become lower compared to the conventional one. The luminescent intensity of the green wavelength band has its peak near 520 nm.

In the optical filter 20, the penetrable rate of the green wavelength band is reduced compared to the conventional one and the penetrable rates of the red and blue wavelength bands are increased compared to the conventional ones in accordance with the luminescent intensity of the PDP 10. Specifically, the penetrable rate of the green wavelength band in the optical filter 20 has the valley-shaped characteristic having the lower limit near 520 nm at which the green luminescent intensity is the highest. Due to this, the brightness of the light output from the PDP device via the optical filter 20 is set to the same brightness as the conventional one. In general, the brightness ratio of red, green, and blue light output from the PDP device is approximately 0.3:0.6:0.1, where the total brightness is assumed to be 1, and the luminescent intensity of the green cell GC is the highest and the luminescent intensity of the blue cell BC is the lowest. The color temperature at this ratio will be about 10,000K (white).

Figure 9:
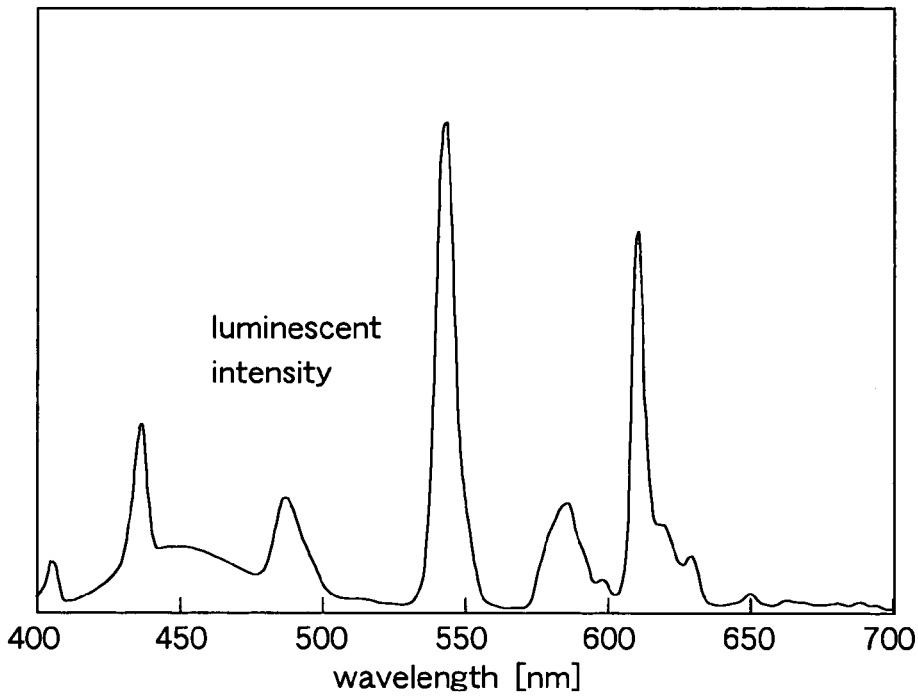
FIG. 9 is a characteristic diagram showing the wavelength dependence of the intensity of the light from a three-wavelength fluorescent lamp.

FIG. 9 shows the wavelength dependence of the intensity of the light from a fluorescent lamp having three wavelengths. The luminescent intensity is obtained by irradiating a standard reflection board (white) with the light from the fluorescent lamp and by measuring the reflected light. In the wavelength band of green output from the fluorescent lamp, the peak of the luminescent intensity is about 540 nm. As shown in FIG. 9, in a fluorescent lamp (outer light) used for room lighting, the brightness of green is relatively higher compared to the red and blue. In the optical filter 20, the penetrable rate of the wavelength band of green whose brightness of outer light is relatively high is reduced. Due to this, it is possible to efficiently reduce the reflectance rate of outer light and thus improve bright room contrast.

Figure 10:
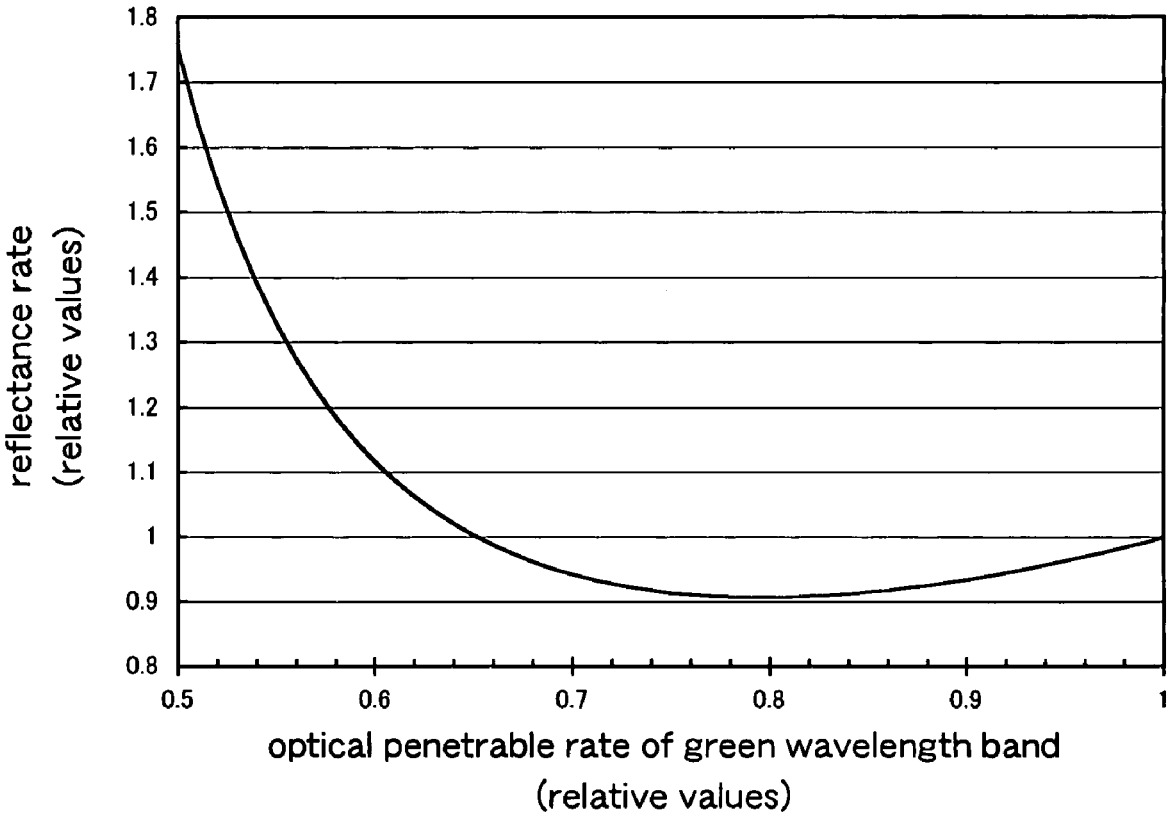
FIG. 10 is a characteristic diagram showing the relationship between the penetrable rate and the reflectance rate of the light of the green wavelength band in the optical filter.

FIG. 10 shows the relationship between the penetrable rate and the reflectance rate of the light of the green wavelength band in the optical filter 20. FIG. 10 shows relative values when the conventional penetrable rate and reflectance rate are assumed to be "1", respectively. Due to this, it is shown that in a region in which the reflectance rate is less than 1, there is an effect to improve bright room contrast. Specifically, when the penetrable rate of the green cell GC is 0.66 or more and less than 1, the reflectance rate is lower than the conventional one. When the penetrable rate is 0.7 or more and 0.92 or less, the reflectance rate can be lowered to 95% or less of the conventional one. When the penetrable rate is 0.8, the reflectance rate is 0.91, the lowest. By the application of the present invention, it is possible to reduce the reflectance rate of outer light to 91% of the conventional one. In other words, the reduction effect of reflectance rate by the application of the present invention is 9% at maximum. The PDP of ALIS system has the discharge gaps GAP on both sides of the bus electrode BE and therefore there is no region in which a discharge is not caused to occur between the bus electrodes BE adjacent to each other. Consequently, it is difficult to provide a so-called black stripe along the bus electrode BE. By the application of the present invention, it is possible to effectively reduce the reflectance rate of outer light without providing a black stripe.

FIG. 11 shows the calculation result for acquiring the characteristic in FIG. 10. WRC, WGC, and WBC indicate the ratios of the cell widths of the red cell RC, the green cell GC, and the blue cell BC to the conventional ones, respectively. RPrate indicates the penetrable rate of the wavelength band of red light emitted from the red cell RC. GPrate indicates the penetrable rate of the wavelength band of green light emitted from the green cell GC. BPrate indicates the penetrable rate of the wavelength band of blue light emitted from the blue cell BC. In each of the cells RC, GC, and BC, by making the product of the cell width and the penetrable rate equal to "1" at all times, the luminescent intensities of red, green, and blue light output from the PDP device are the same as the conventional ones and the color temperature is also the same as the conventional one.

The reflectance rate Rrate of outer light is obtained by the following expression (1). The constants 0.1, 0.6, and 0.3 in the expression indicate the brightness ratio of red, green, and blue light output from the PDP device. The characteristic curve in FIG. 10 is obtained by plotting the penetrable rate GPrate of the green cell GC and the reflectance rate Rrate obtained from the expression (1).

$$Rrate=0.1\times RPrate^2+0.6\times GPrate^2+0.3\times BPrate^2 \quad (1)$$

As described above, in the first embodiment, the penetrable rate of green light emitted from the green cell GC of which the luminescent intensity is the highest relatively is set lower than those of other colors. Due to this, it is possible to reduce the reflectance rate of outer light incident on the side of the front plate 16 of the PDP 10. Artificial lighting such as a fluorescent lamp is often used for lighting in a room in which the PDP device is installed. In general, in artificial lighting, the brightness of green is relatively higher compared to red and blue. Because of this, particularly in a room environment, it is possible to efficiently reduce the reflectance rate of outer light and improve bright room contrast.

In addition, by further increasing the luminescent intensity of the green cell GC by widening the cell width, it is possible to further reduce the penetrable rate of the green light and improve bright room contrast. The cell width becomes narrow relatively, and by increasing the penetrable rate of red and blue light with respect to the red cell RC and the blue cell BC in which the luminescent intensity is reduced, it is possible to maintain the brightness ratio of red, green, and blue light output from the PDP device at 0.3:0.6:0.1 (color temperature=about 10,000 K) the same as the conventional one. As a result, it is possible to improve bright room contrast without disturbing white balance.

Figure 12:
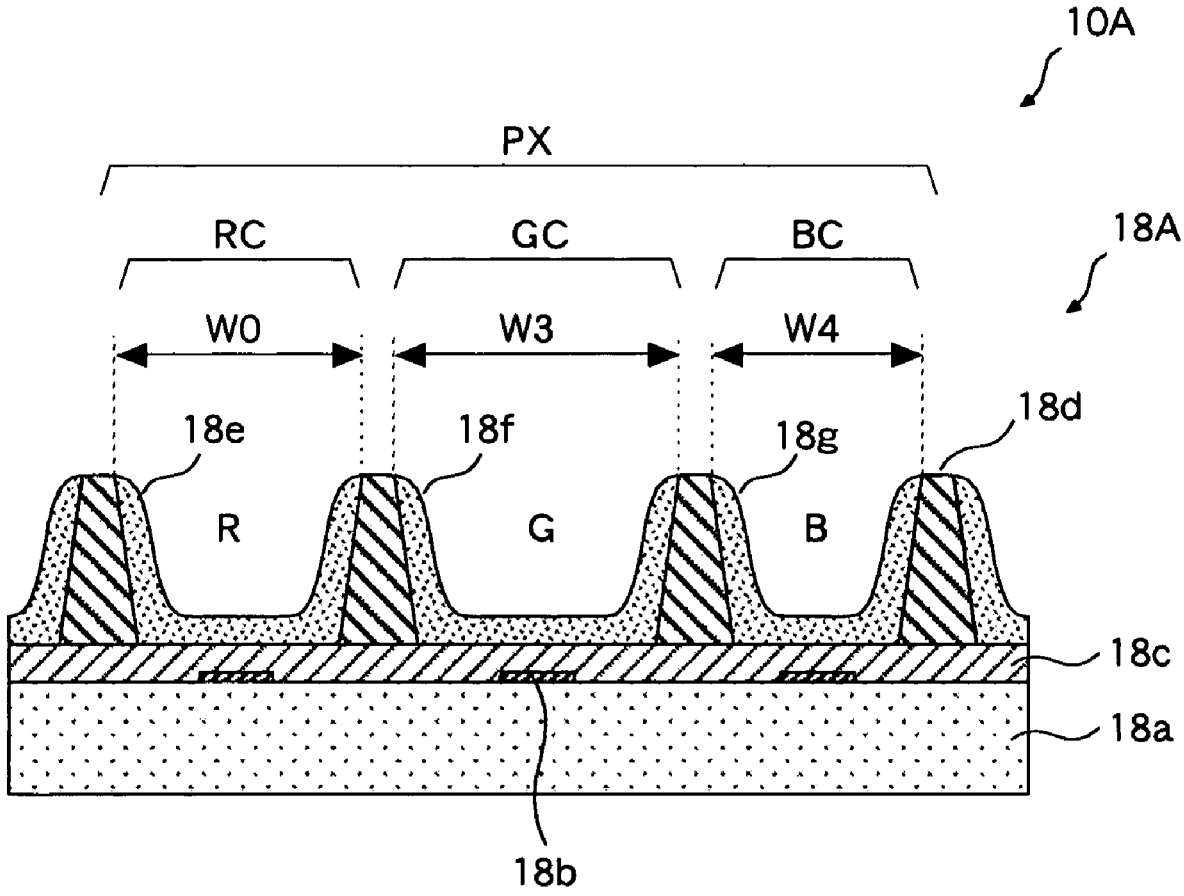
FIG. 12 is a sectional view showing a rear plate of a PDP in a second embodiment of a display device of the present invention.

FIG. 12 shows a rear plate 18A of a PDP 10A in a second embodiment of a display device of the present invention. The same symbols and numerals are assigned to the same components as those explained in the first embodiment and their detailed explanation is omitted. In the present embodiment, cell width W0 of the red cell RC is the same as the conventional one. Cell width W3 of the green cell GC is wider than the conventional one. Cell width W4 of the blue cell BC is narrower than the conventional one. The width of the pixel PX composed of the red cell RC, the green cell GC, and the blue cell BC linked together is the same as the conventional one. In other words, the cell width of the blue cell BC is designed to be narrower by the amount by which the cell width of the green cell GC is widened. Other configurations of the PDP 10A are the same as those in FIG. 2. The configuration of the PDP device except for the PDP 10A is also the same as that in FIG. 1.

Figure 13:
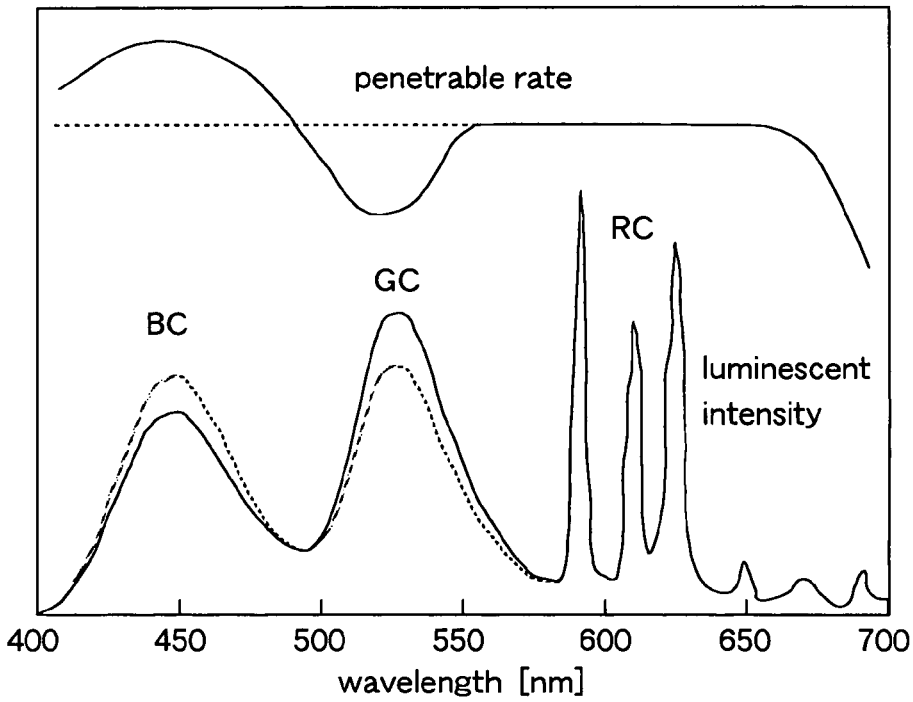
FIG. 13 is a characteristic diagram showing the wavelength dependence of the penetrable rate of the optical filter and the luminescent intensity of the cell in the second embodiment.

FIG. 13 shows the wavelength dependence of the penetrable rate of the optical filter (corresponding to symbol 20 in FIG. 1) and the luminescent intensity of the cell in the second embodiment. The broken line in the figure shows the conventional characteristic and the solid line shows the characteristic of the present invention. In the present embodiment, the luminescent intensity of the blue cell BC with a narrow cell width becomes lower compared to the conventional one. In other words, the blue cell BC has a narrower cell width compared to the red cell RC in order to reduce the amount of light that will be excessive when the penetrable rate of the optical filter is increased. The luminescent intensity of the green cell GC with a wide cell width is higher compared to the conventional one and the luminescent intensity of the red cell RC with the same cell width as the conventional one is the same as the conventional one.

In the optical filter, the penetrable rate of the green wavelength band is reduced compared to the conventional one and the penetrable rate of the blue wavelength band is increased compared to the conventional one in accordance with the luminescent intensity from the PDP. The penetrable rate of the red wavelength band is the same as the conventional one. Due to this, the brightness of the red, green, and blue light output from the PDP device via the optical filter is the same as the conventional one. By reducing the penetrable rate of the green wavelength band in which the brightness is relatively high, using the optical filter, it is possible to efficiently reduce the reflectance rate of outer light and improve bright room contrast.

Figure 14:
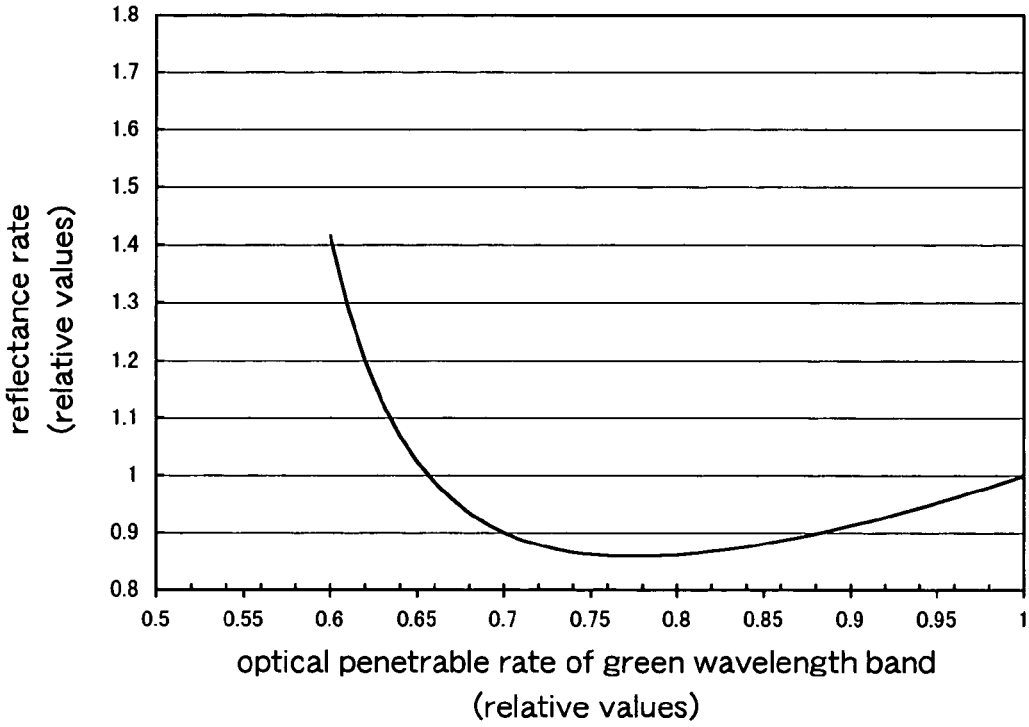
FIG. 14 is a characteristic diagram showing the relationship between the penetrable rate and the reflectance rate of the light of the green wavelength band in the optical filter in the second embodiment.

FIG. 14 shows the relationship between the penetrable rate and the reflectance rate of light of the green wavelength band in the optical filter in the second embodiment. FIG. 14 indicates relative values when the conventional penetrable rate and reflectance rate are assumed to be "1", respectively, as in FIG. 1 described above. In the present embodiment also, when the penetrable rate of the green cell GC is 0.66 or more and less than 1, the reflectance rate is lower than the conventional one. Further, when the penetrable rate is 0.68 or more and 0.94 or less, the reflectance rate can be reduced to 95% or less of the conventional one. When the penetrable rate is 0.78, the reflectance rate is 0.86, the lowest. Therefore, by the application of the present invention, the reflectance rate can be reduced to 86% of the conventional one. In other words, the reduction effect of reflectance rate by the application of the present invention is 14% at maximum.

FIG. 15 shows the calculation result for acquiring the characteristic in FIG. 14. The meaning of each parameter is the same as that in FIG. 11. The reflectance rate Rrate of outer light is obtained by the above-described expression (1).

As described above, in the second embodiment also, the same effects as those in the first embodiment described above can be obtained. Further, in the present embodiment, the luminescent intensity is adjusted by the cell width and the amount of increase in the cell width of the green cell GC is made to be equal to the amount of decrease in the cell width of the blue cell BC in which the ratio of the luminescent intensity is the lowest. Due to this, with the reduction in the luminescent intensity of the blue cell BC, it is possible to keep the influence of the increase in the penetrable rate on the reflectance rate to a minimum also when the penetrable rate of the blue wavelength band is increased. As a result, compared to the first embodiment, it is possible to further reduce the reflectance rate of outer light and to considerably improve bright room contrast compared to the conventional one.

By making the luminescent intensity of the red cell RC equal to the conventional one, it is no longer necessary to take into account the red wavelength band in the design of the optical filter and thus the design efficiency can be improved.

Figure 16:
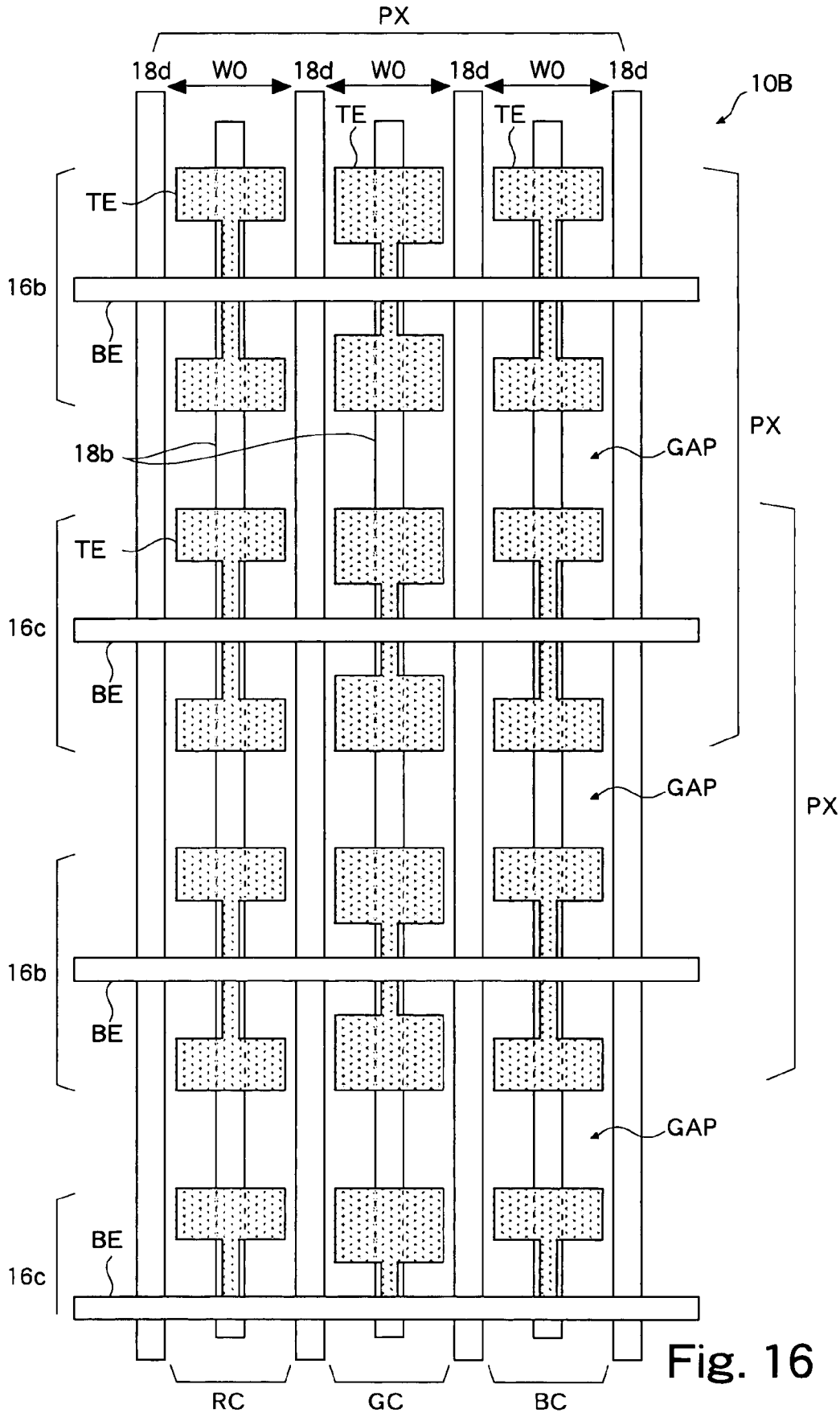
FIG. 16 is a plan view showing a PDP in a third embodiment of a display device of the present invention.

FIG. 16 shows a PDP 10B in a third embodiment of a display device of the present invention. The same symbols are assigned to the same components as those explained in the first embodiment and their detailed explanation is omitted. In the present embodiment, the area of the transparent electrode TE of the green cell GC is designed to be larger compared to the area of the transparent electrode of other cell. The area of the transparent electrode of the red cell RC and the blue cell BC is the same as the conventional one. Because of this, the luminescent intensity of the green cell GC becomes higher compared to the conventional one and the luminescent intensities of the red cell RC and the blue cell BC are the same as the conventional ones.

All of the cell widths W0 of the red cell RC, the green cell GC, and the blue cell BC are the same as the conventional ones. Consequently, the width of the pixel PX composed of the red cell RC, the green cell GC, and the blue cell BC linked together is the same as the conventional one. Other configurations of the PDP 10B are the same as those in FIG. 2. The configuration of the PDP device except for the PDP 10B is also the same as that in FIG. 1.

Figure 17:
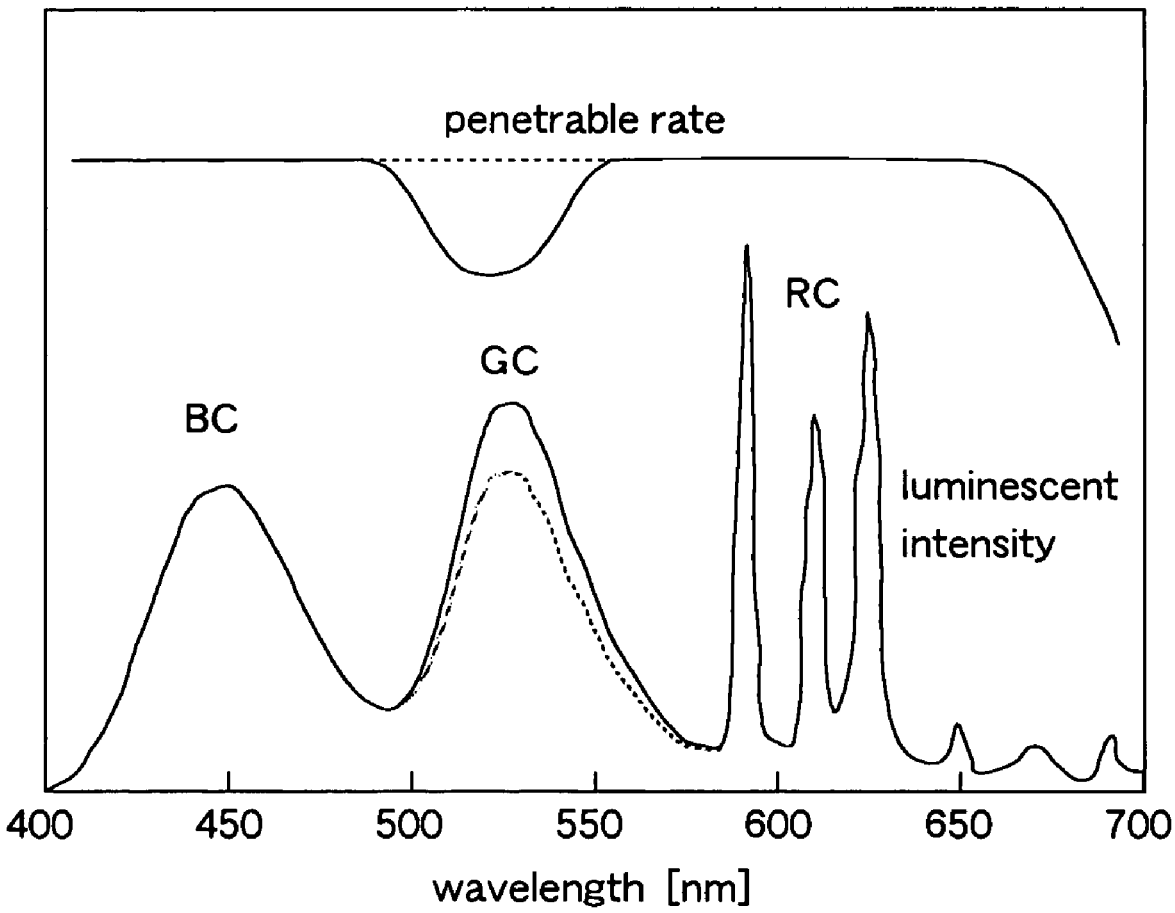
FIG. 17 is a characteristic diagram showing the wavelength dependence of the penetrable rate of the optical filter and the luminescent intensity of the cell in the third embodiment.

FIG. 17 shows the wavelength dependence of the penetrable rate of the optical filter (corresponding to symbol 20 in FIG. 1) and the luminescent intensity of the cell in the third embodiment. The broken line in the figure shows the conventional characteristic and the solid line shows the characteristic of the present invention. In the present embodiment, the luminescent intensity of the green cell GC with a large electrode area becomes higher compared to the conventional one and the luminescent intensities of the red cell RC and the blue cell BC with the same electrode area as the conventional one are the same as the conventional ones.

In the optical filter, the penetrable rate of the green wavelength band is reduced compared to the conventional one and the penetrable rates of the red and blue wavelength bands are set to those the same as the conventional ones in accordance with the luminescent intensity of the PDP. Due to this, the brightness of the red, green, and blue light output from the PDP device via the optical filter is the same as the conventional one. By reducing the penetrable rate of the green wavelength band in which the brightness is relatively high using the optical filter, it is possible to efficiently reduce the reflectance rate of outer light and to improve bright room contrast.

As described above, in the third embodiment also, the same effects as those in the first and second embodiments described above can be obtained. Further, in the present embodiment, since the luminescent intensity is adjusted in accordance with the area of the transparent electrode TE, it is possible to manufacture the PDP 10B with a low reflectance rate of outer light by changing only the photo mask of the transparent electrode TE. The spacing of the barrier ribs 18*d* is the same as the conventional one. As a result, it is possible to efficiently reduce the reflectance rate of outer light and improve bright room contrast by keeping the change in the manufacturing process to a minimum.

By making the luminescent intensities of the red cell RC and the blue cell BC equal to the conventional ones, it is no longer necessary to take into account the red and blue wavelength bands in the design of the optical filter and thus the design efficiency can be further improved.

Figure 18:
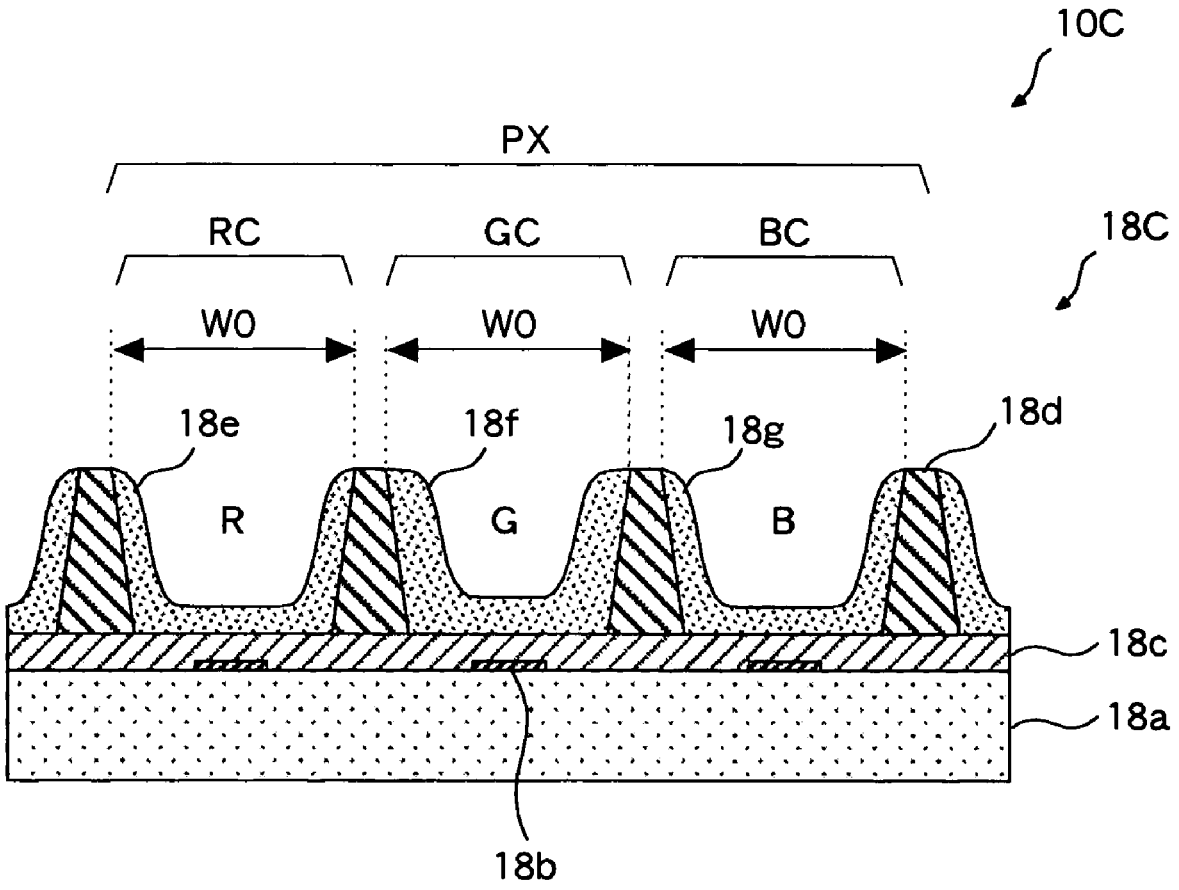
FIG. 18 is a sectional view showing a rear plate of a PDP in a fourth embodiment of a display device of the present invention.

FIG. 18 shows a rear plate 18C of a PDP 10C in a fourth embodiment of a display device of the present invention. The same symbols are assigned to the same components as those explained in the first embodiment and their detailed explanation is omitted. In the present embodiment, the cell widths W0 of the red cell RC, the green cell GC, and the blue cell BC are the same as the conventional ones. The thickness of the phosphor layer 18*f* of the green cell GC is thicker compared to the conventional one and the thickness of the phosphor layers 18*e* and 18*g* of the red cell RC and the blue cell BC is the same as the conventional one. Other configurations of the PDP 10C are the same as those in FIG. 2. The configuration of the PDP device except for the PDP 10*c* is also the same as that in FIG. 1.

In the present embodiment, only the luminescent intensity of the green cell GC with a thick phosphor layer becomes relatively higher compared to the conventional one. The penetrable rate of the optical filter (corresponding to symbol 20 in FIG. 1) is set lower only for the wavelength band of green light emitted from the green cell GC. Due to this, the wavelength dependence of the penetrable rate of the filter and the luminescent intensity of the cell is approximately the same as that in FIG. 17.

As described above, in the fourth embodiment also, the same effects as those in the first, second, and third embodiments described above can be obtained. Further, in the present embodiment, since the luminescent intensity is adjusted by thickening the phosphor layer 18*f* of the green cell GC, it is possible to manufacture the PDP 10C with a low reflectance rate of outer light only by changing the concentration of the phosphor 18*f* in the application process of the phosphor 18*f*. As a result, it is possible to efficiently reduce the reflectance rate of outer light and improve bright room contrast by keeping the change in the manufacturing process to a minimum.

Figure 19:
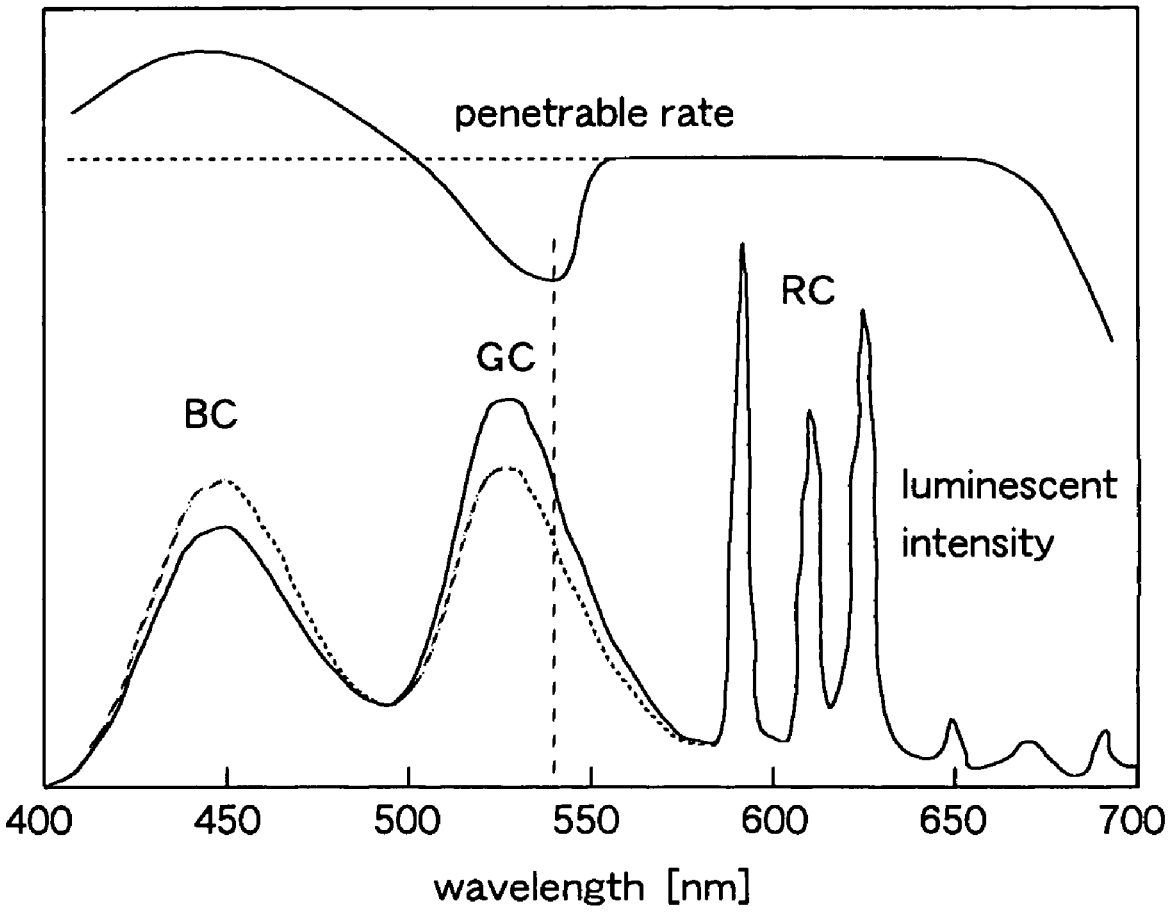
FIG. 19 is a characteristic diagram showing the wavelength dependence of the penetrable rate of the optical filter and the luminescent intensity of the cell in a fifth embodiment of a display device of the present invention.

FIG. 19 shows the wavelength dependence of the penetrable rate of an optical filter (corresponding to symbol 20 in FIG. 1) and the luminescent intensity of a cell in a fifth embodiment of a display device of the present invention. In the optical filter, the penetrable rate of the green wavelength band has the valley-shaped characteristic having a lower limit at 540 nm at which the luminescent intensity of green light output from the fluorescent lamp shown in FIG. 9 is the highest. In addition, it is desirable to design the penetrable rate characteristic so as to be valley-shaped having a lower limit at any one at least in the range of 530 to 550 nm. Due to this, it is possible to efficiently reduce the reflectance rate of outer light in the vicinity of 540 nm at which the luminescent intensity of the fluorescent lamp is the highest. Other characteristics of the optical filter are the same as those in the second embodiment (FIG. 13). The configuration except for the optical filter is also the same as that in the second embodiment. In other words, the display device in the present embodiment is a plasma display panel device.

As described above, in the fifth embodiment also, the same effects as those in the first and second embodiments described above can be obtained. In the present embodiment, by setting the penetrable rate of the light in the vicinity of 540 nm at which the luminescent intensity of green light output from the fluorescent lamp is the highest to the lowest one, it is possible to further reduce the reflectance rate of the fluorescent lamp (outer light) and to considerably improve bright room contrast compared to the conventional case.

Figure 20:
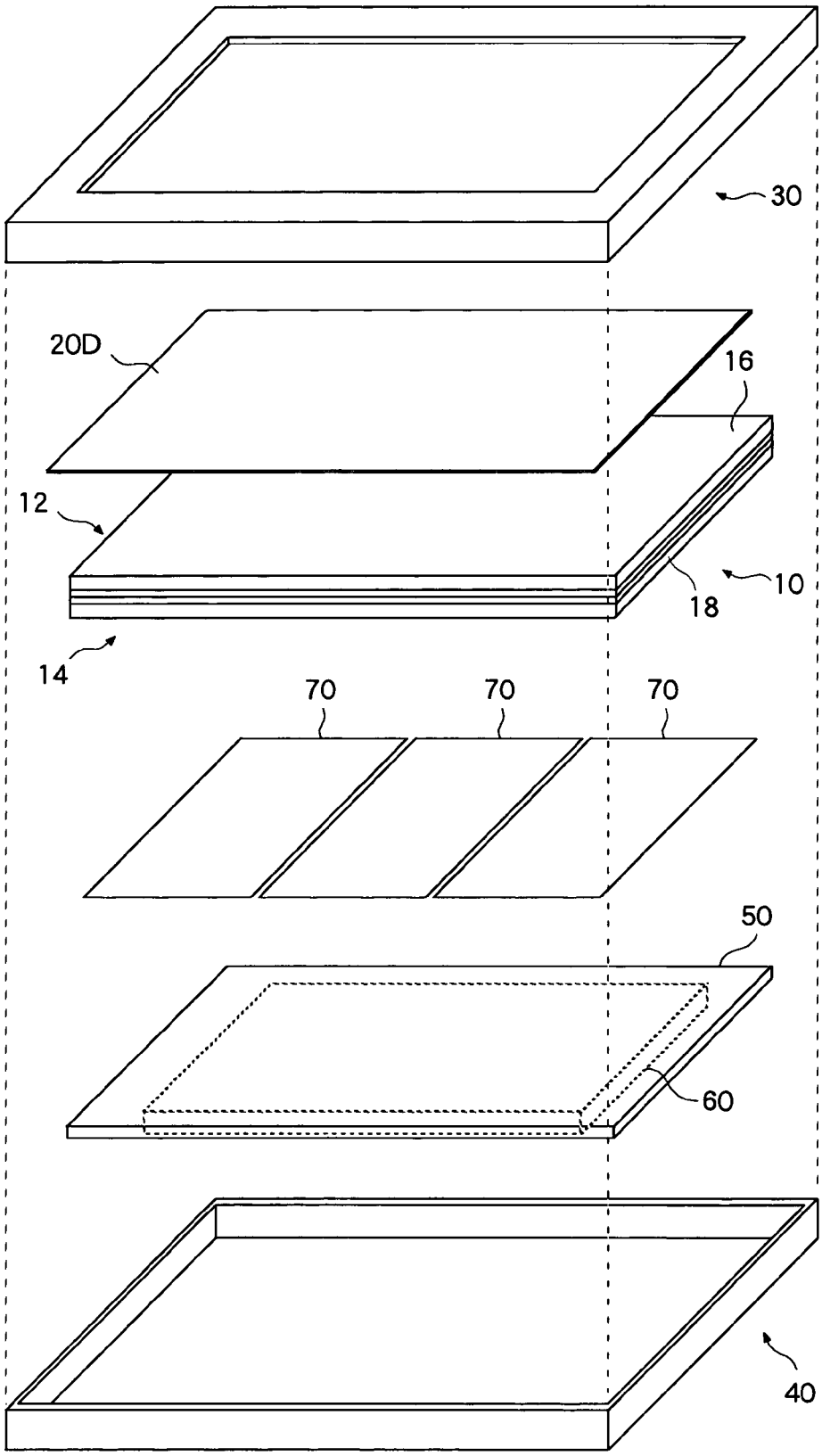
FIG. 20 is an exploded perspective view showing a sixth embodiment of a display device of the present invention.

FIG. 20 shows a sixth embodiment of a display device of the present invention. The display device of the present embodiment is configured as a plasma display panel device. The same numerals are assigned to the same components as those explained in the first embodiment and their detailed explanation is omitted. The PDP device in the present embodiment has an optical filter 20D instead of the optical filter 20 in the first embodiment. The optical filter 20D is pasted to the surface of the front plate 16 of the PDP 10 and integrated with the PDP 10. Other configurations are the same as those in the first embodiment (FIG. 1). As described above, in the sixth embodiment also, the same effects as those in the first embodiment described above can be obtained.

Figure 21:
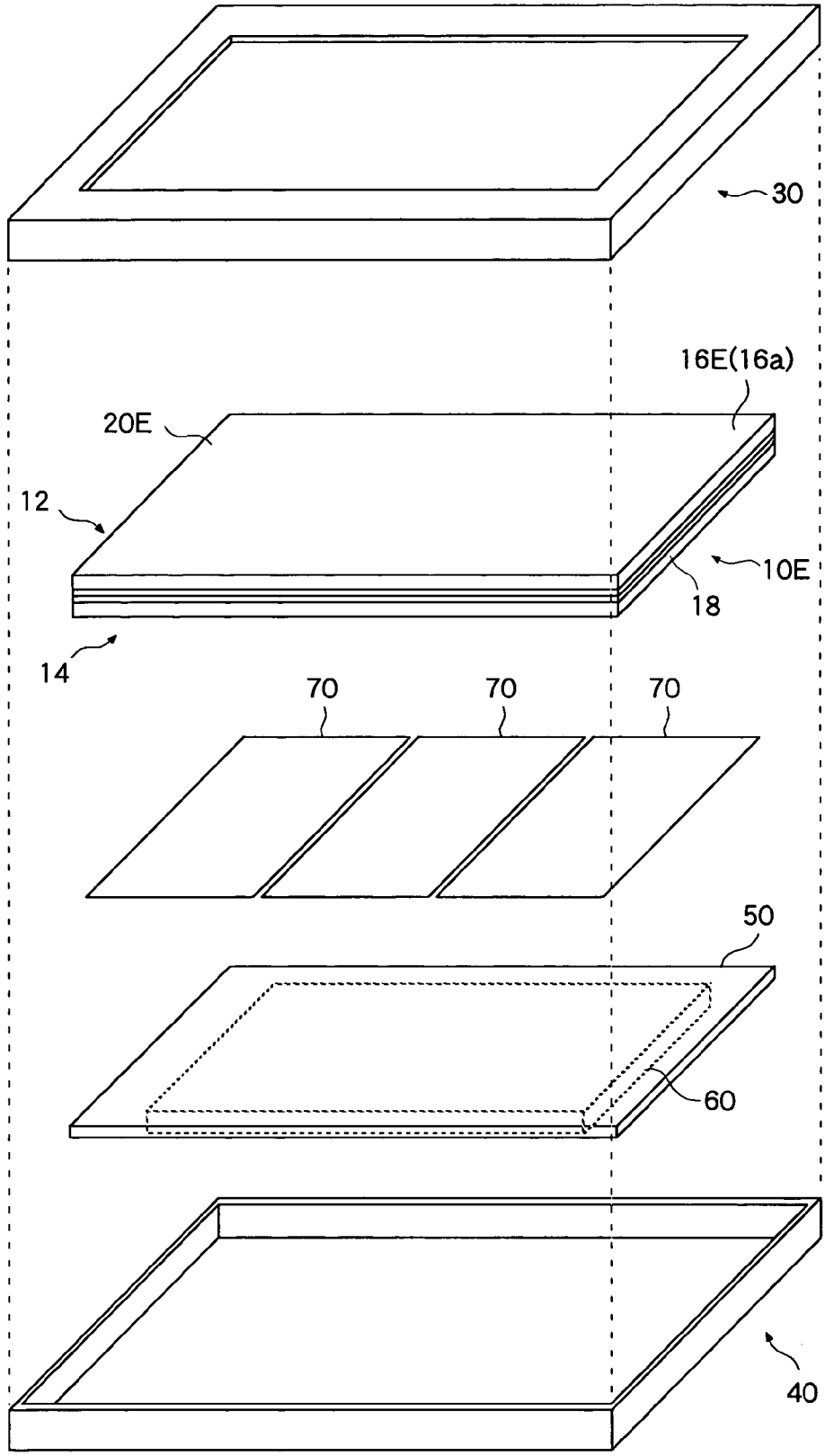
FIG. 21 is an exploded perspective view showing a seventh embodiment of a display device of the present invention.
Figure 22:
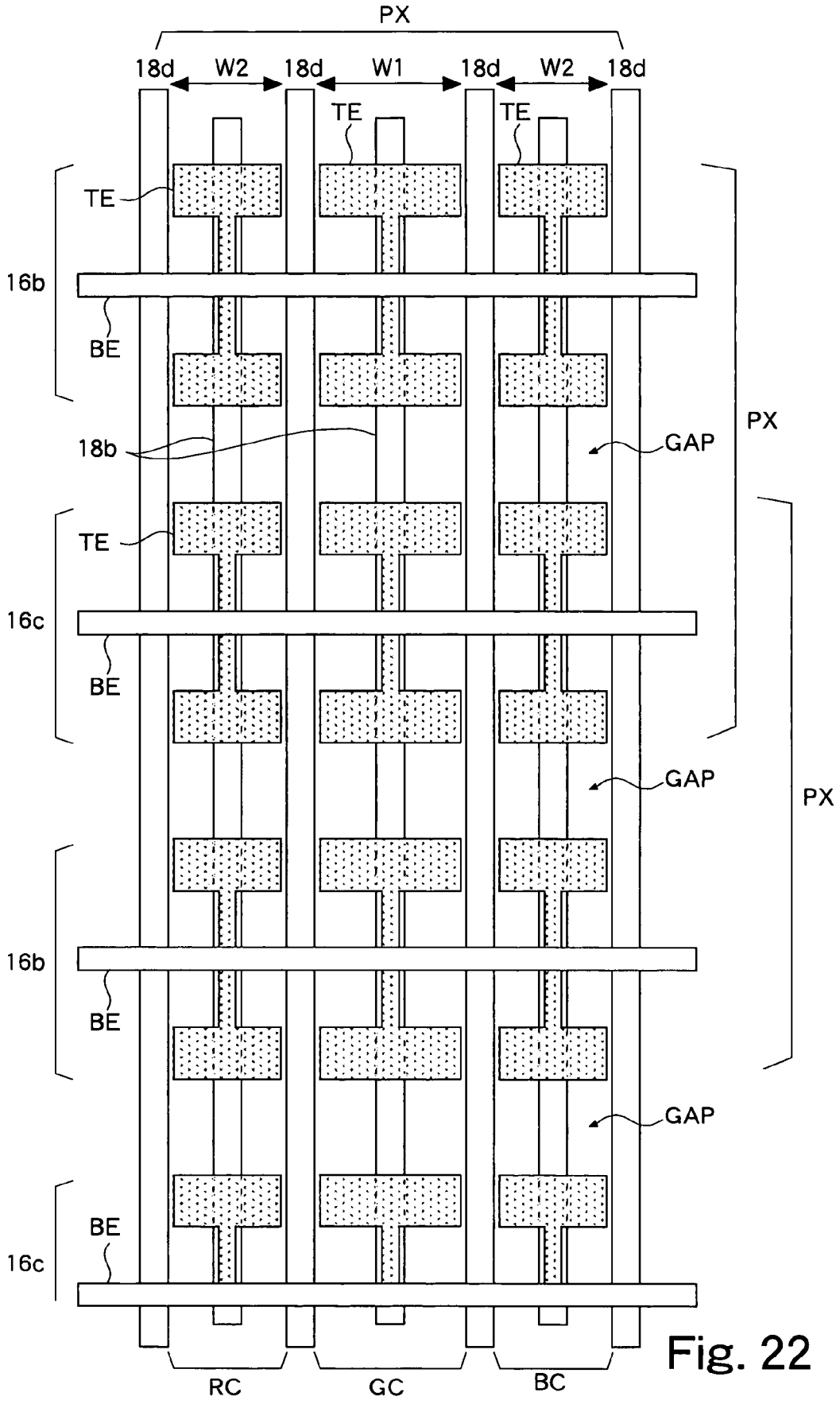
FIG. 22 is a plan view showing another example of the PDP.
Figure 23:
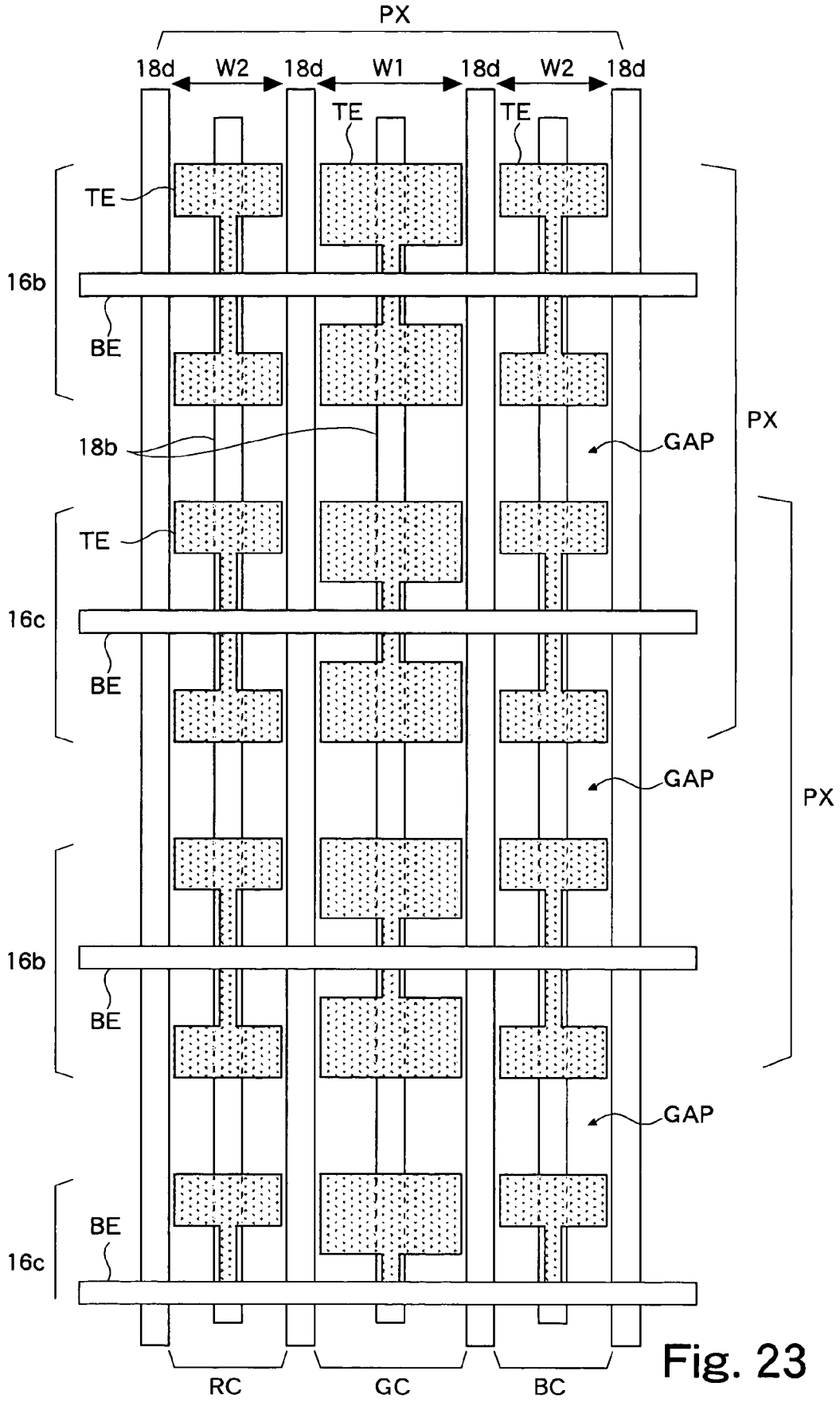
FIG. 23 is a plan view showing another example of the PDP.
Figure 24:
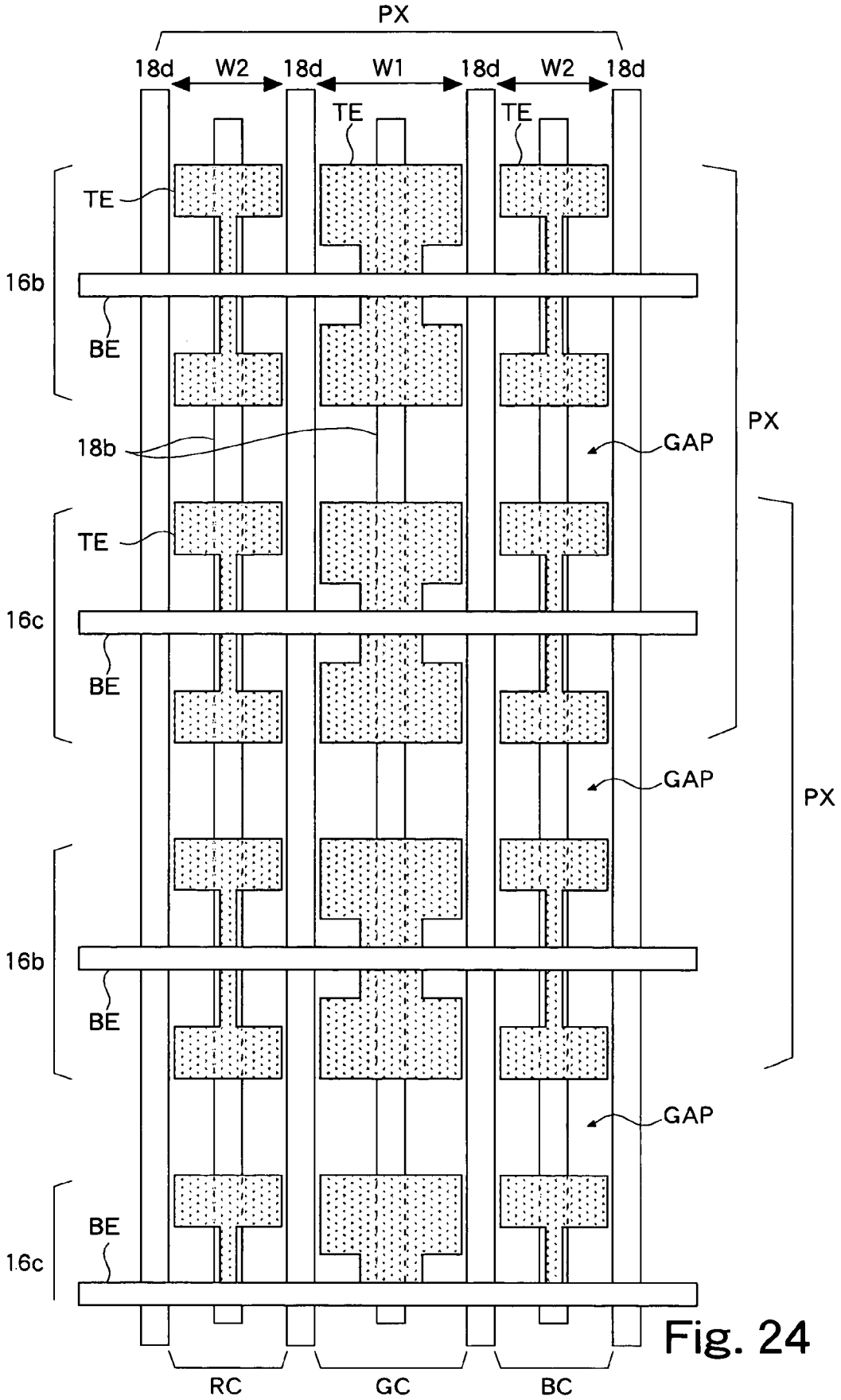
FIG. 24 is a plan view showing another example of the PDP.
Figure 25:
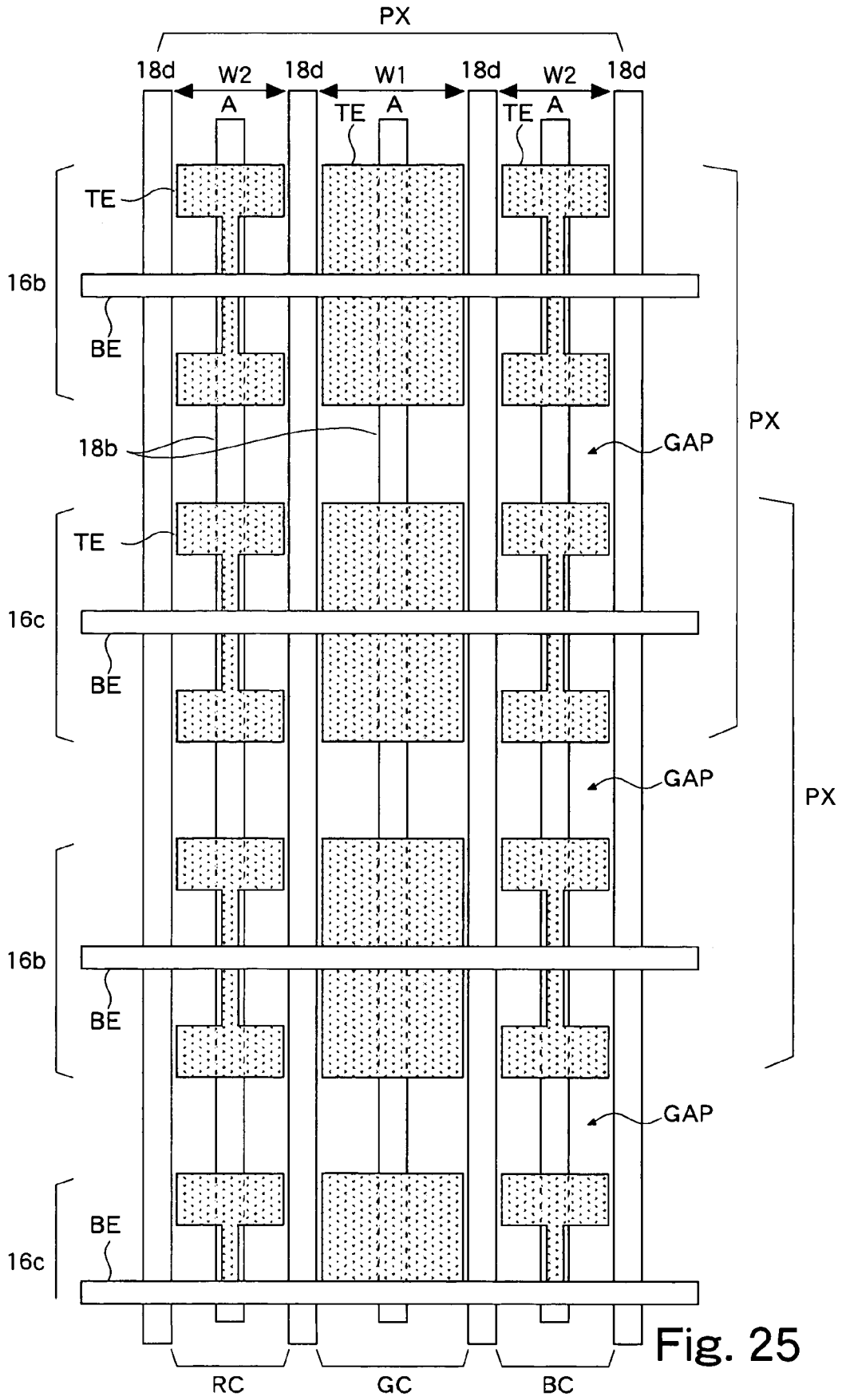
FIG. 25 is a plan view showing another example of the PDP.

FIG. 21 shows a seventh embodiment of a display device of the present invention. The display device of the present embodiment is configured as a plasma display panel device. The same numerals are assigned to the same components as those explained in the first embodiment and their detailed explanation is omitted. In the PDP device of the present embodiment, a front plate 16E of a PDP 10E has the function of the optical filter 20 in the first embodiment. Specifically, the glass base 16*a* (FIG. 2) of the front plate 16E functions as the optical filter 20E. Other configurations are the same as those in the first embodiment (FIG. 1). As described above, in the seventh embodiment also, the same effects as those in the first embodiment described above can be obtained.

Incidentally, in the first embodiment (FIG. 4) described above, an example is described in which the cell width W1 of the green cell GC is made wider than the cell width W2 of other cells in order to increase the luminescent intensity of green light emitted from the green cell GC. The present invention is not limited to the embodiment. For example, as shown in FIG. 22, FIG. 23, FIG. 24, and FIG. 25, by making the area of the transparent electrode TE of the green cell GC with a wide cell width larger than the area of the transparent electrode TE of other cells, it is possible to further increase the luminescent intensity of the green cell GC. As a result, it is made possible to further reduce the penetrable rate of the green wavelength band of the optical filter 20 and further improve bright room contrast.

Figure 26:
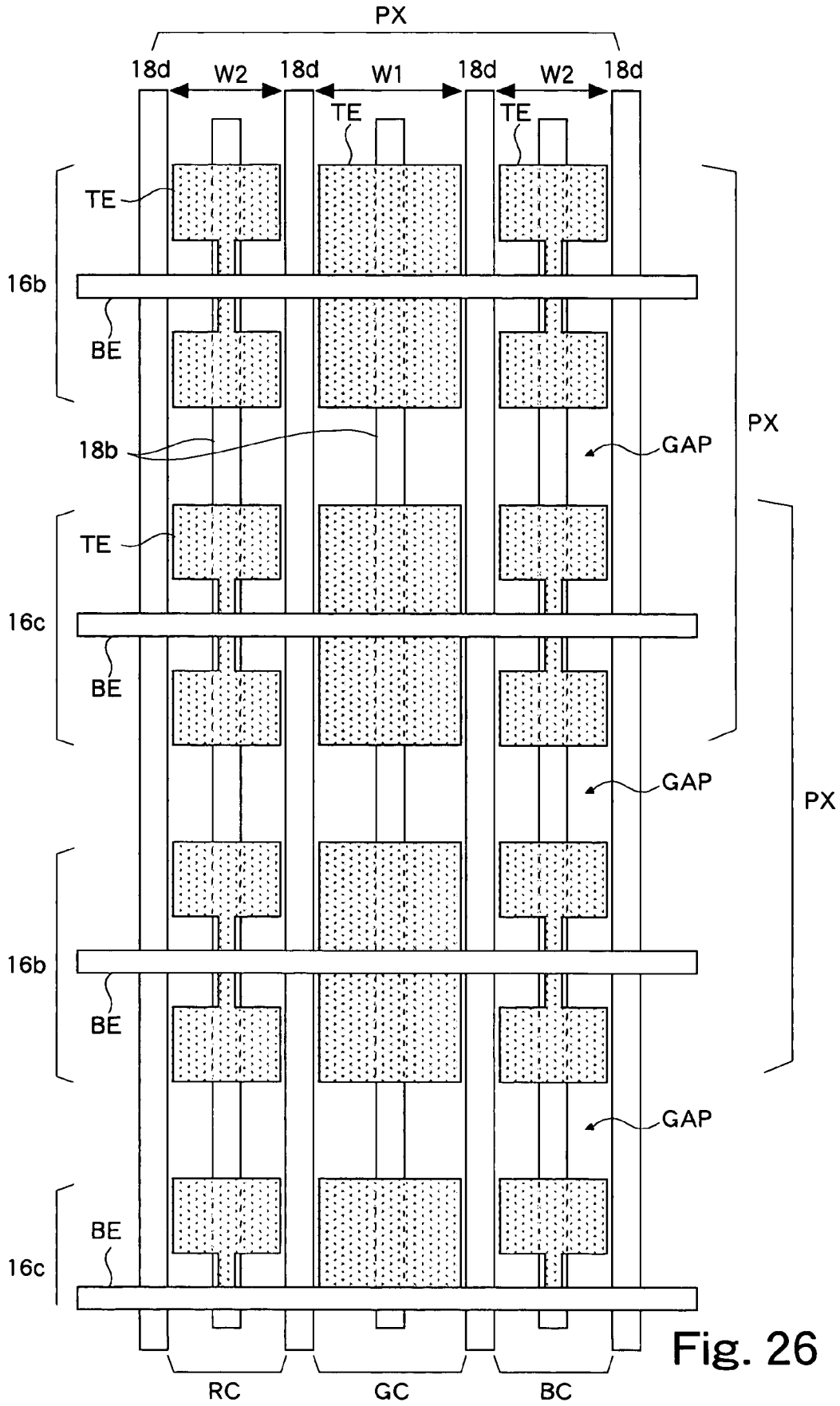
FIG. 26 is a plan view showing another example of the PDP.

In addition, as shown in FIG. 26, by making the area of not only the transparent electrode TE of the green cell GC but also the transparent electrodes TE of the red cell RC and the blue cell BC large, it is possible to increase the luminescent intensities of the red and blue wavelength bands. Due to this, it is possible to make the characteristic of the penetrable rate and the characteristic of the luminescent intensity shown in FIG. 8 equal to those shown in FIG. 17. As a result, it is no longer necessary to increase the penetrable rates of the red and blue wavelength bands and it is possible to sufficiently reduce the reflectance rate of outer light and to improve bright room contrast.

Figure 27:
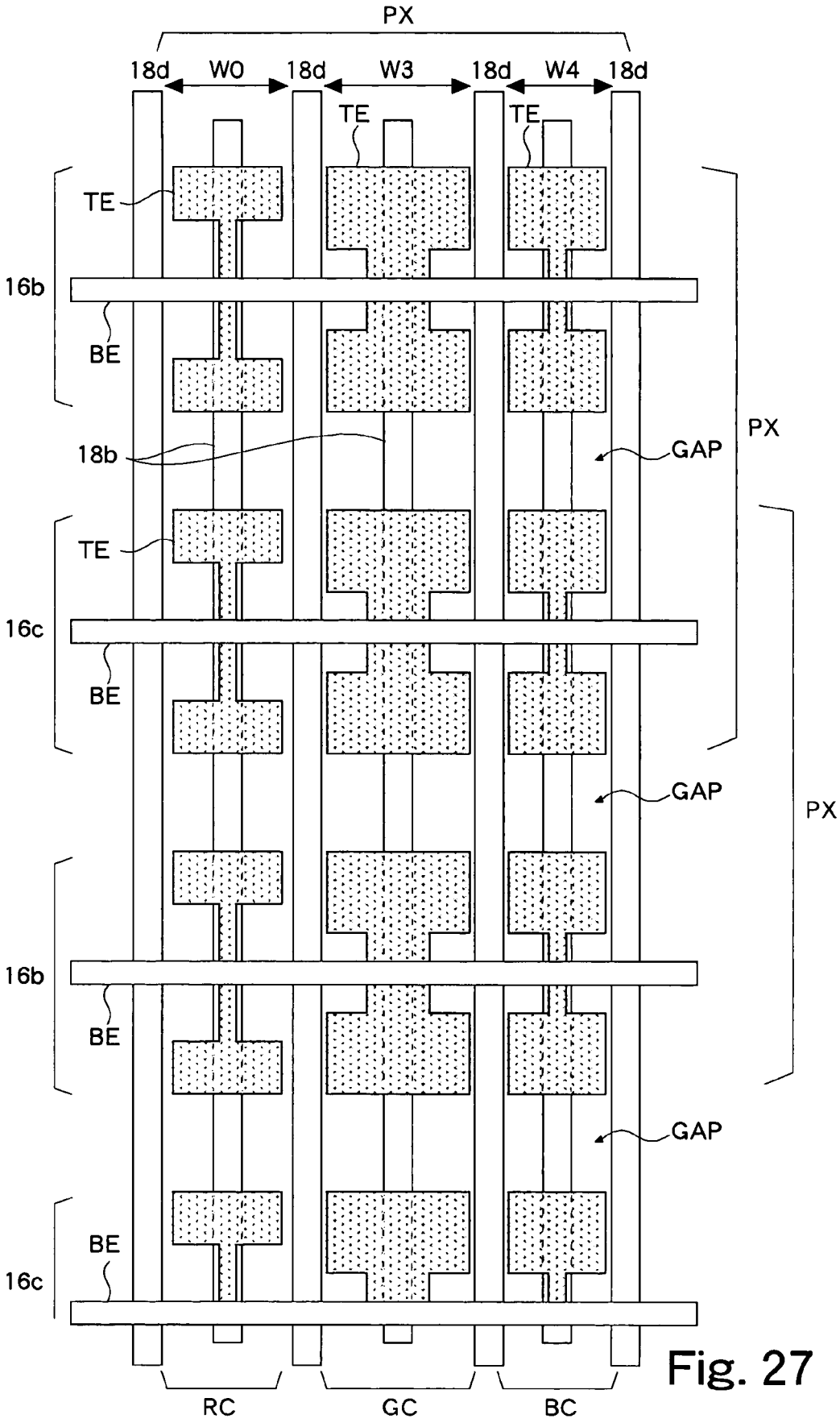
FIG. 27 is a plan view showing another example of the PDP.

Further, as to the second embodiment (FIG. 12), as shown in FIG. 27, by increasing the area of the transparent electrode TE in the blue cell BC in which the cell width W4 is narrower compared to the conventional cell width W0, it is possible to increase the luminescent intensity of the blue cell BC. Due to this, it is possible to make the characteristic of the penetrable rate and the characteristic of the luminescent intensity shown in FIG. 13 equal to those shown in FIG. 17. As a result, it is no longer necessary to increase the penetrable rate of the blue wavelength band and therefore it is possible to sufficiently reduce the reflectance rate of outer light and to improve bright room contrast.

The improvement of the luminescent intensity can be realized by applying at least any one of the three conditions that (a) the cell width is widened, (b) the area of the transparent electrode is increased, and (c) the phosphor layer of the cell is thickened. For example, it may also be possible to widen the cell width of the green cell GC, increase the area of the transparent electrode, and further thicken the phosphor layer 18*f*.

In the fifth embodiment (FIG. 19) described above, an example is described, in which the characteristic of the optical filter in the second embodiment (FIG. 13) is changed. The present invention is not limited to such an embodiment. For example, in the optical filter of the first embodiment (FIG. 8) or of the seventh embodiment (FIG. 17), it may also be possible to design the characteristic of the penetrable rate of the green wavelength band to be valley-shaped having a lower limit at 540 nm at which the luminescent intensity of green light output from the fluorescent lamp is the highest. In addition, it is desirable to design the penetrable rate characteristic to be valley-shaped having a lower limit at any one at least in the range of 530 to 550 nm. In this case also, it is possible to further reduce the reflectance rate of the fluorescent lamp (outer light) and to considerably improve bright room contrast compared to the conventional case.

The sixth embodiment (FIG. 20) and the seventh embodiment (FIG. 21) described above can be applied to the PDP shown in the second, third, and fourth embodiments, or in FIG. 22 to FIG. 27.

In the embodiments described above, an example is described, in which the present invention is applied to a plasma display panel device. The present invention is not limited to such embodiments. For example, the same effects can be obtained by applying the present invention also to an organic electroluminescence display, an inorganic electroluminescence display, a surface-conduction Electron-emitter Display, or a liquid crystal display device. The present invention can be applied to a display device having a plurality of kinds of cells that output light having colors different from one another and an optical filter that absorbs at least a portion of a wavelength band of light output from the cell.

The invention is not limited to the above embodiments and various modifications may be made without departing from the spirit and scope of the invention. Any improvement may be made in part of all of the components.

What is claimed is:

1. A display device comprising:

a red cell;

a green cell; and a blue cell, wherein each cell is arranged in a matrix in order to display an image and which output red light, green light, and blue light, respectively; and an optical filter provided uniformly on each of said cells and on the output side of light from said cells, wherein the penetrable rate of at least a portion of a wavelength band of light output from the green cell having the highest luminescent intensity is lower than the penetrable rates of wavelength bands of said red cell and said blue cell, wherein:

in the green cell, the luminescent intensity is further increased in order to compensate for the amount of light that will run short when the penetrable rate of said optical filter is reduced, and the penetrable rate of the wavelength band of light emitted from said green cell in said optical filter is equal to or greater than 0.66 of the penetrable rate of the wavelength band of light emitted from said red cell and less than 1.

2. A display device comprising:

a red cell;

a green cell; and a blue cell, wherein each cell is arranged in a matrix in order to display an image and which output red light, green light, and blue light, respectively; and an optical filter provided uniformly on each of said cells and on the output side of light from said cells, wherein the penetrable rate of at least a portion of a wavelength band of light output from the green cell having the highest luminescent intensity is lower than the penetrable rates of wavelength bands of said red cell and said blue cell, wherein:

in the green cell, the luminescent intensity is further increased in order to compensate for the amount of light that will run short when the penetrable rate of said optical filter is reduced, the cell with the lowest luminescent intensity is said blue cell, said optical filter has a characteristic that the penetrable rate of light emitted from said blue cell is higher than that of light emitted from said red cell, said blue cell has a narrower cell width compared to said red cell in order to reduce the amount of light that will be excessive when the penetrable rate of said optical filter is increased, and the penetrable rate of the wavelength band of light emitted from said green cell in said optical filter is equal to or greater than 0.66 of the penetrable rate of the wavelength band of light emitted from said red cell and less than 1.

* * * * *